US009969198B2

(12) United States Patent
Satoh et al.

(10) Patent No.: US 9,969,198 B2
(45) Date of Patent: May 15, 2018

(54) THERMAL TRANSFER INK RIBBON FOR CARTRIDGE AND PRINTING APPARATUS

(71) Applicant: Brother Kogyo Kabushiki Kaisha, Nagoya-shi, Aichi-ken (JP)

(72) Inventors: Noriaki Satoh, Nagoya (JP); Haruki Matsumoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/273,776

(22) Filed: Sep. 23, 2016

(65) Prior Publication Data

US 2017/0120648 A1 May 4, 2017

(30) Foreign Application Priority Data

Nov. 4, 2015 (JP) ..... 2015-216678

(51) Int. Cl.

| | |
|---|---|
| ***B41J 31/05*** | (2006.01) |
| ***B41J 2/325*** | (2006.01) |
| ***B41J 32/00*** | (2006.01) |
| ***B41M 5/382*** | (2006.01) |
| ***B41M 5/395*** | (2006.01) |

(Continued)

(52) U.S. Cl.

CPC ..... *B41J 31/05* (2013.01); *B41J 2/325* (2013.01); *B41J 3/00* (2013.01); *B41J 31/00* (2013.01); *B41J 32/00* (2013.01); *B41M 5/38214* (2013.01); *B41M 5/395* (2013.01); *B41M 5/41* (2013.01); *B41M 5/42* (2013.01); *B41M 2205/06* (2013.01); *B41M 2205/30* (2013.01);

(Continued)

(58) Field of Classification Search

CPC ... B41J 31/05; B41J 2/325; B41J 32/00; B41J 3/00; B41M 5/38214; B41M 5/395; B41M 5/41; B41M 5/42; B41M 2205/06; B41M 2205/30; B41M 2205/36; B41M 2205/38

See application file for complete search history.

(56) References Cited

U.S. PATENT DOCUMENTS

| | | | | |
|---|---|---|---|---|
| 6,132,119 | A | 10/2000 | Nakajima et al. | |
| 6,139,947 | A | 10/2000 | Miyakusa et al. | |
| 2002/0061391 | A1* | 5/2002 | Hayashi ..... | B41M 5/38214 428/209 |

FOREIGN PATENT DOCUMENTS

| | | | |
|---|---|---|---|
| EP | 0748699 | A2 | 12/1996 |
| EP | 0980765 | A2 | 2/2000 |

(Continued)

OTHER PUBLICATIONS

Apr. 11, 2017—(EP) Extended Search Report—App 16190481.8.

*Primary Examiner* — Julian Huffman
*Assistant Examiner* — Michael Konczal
(74) *Attorney, Agent, or Firm* — Banner & Witcoff, Ltd.

(57) ABSTRACT

A thermal transfer ink ribbon includes a backcoat layer, a ribbon base layer formed on the backcoat layer, a release layer formed on the ribbon base layer and containing resin and wax, an ink layer formed on the release layer and containing a first resin and a second resin, an aluminum layer formed on the ink layer, and an adhesive layer formed on the aluminum layer and containing resin and wax. The first resin is transparent or translucent and contains at least one of polyester resin, styrene-acrylic resin, and polyethylene resin. The second resin is transparent or translucent and contains at least one of polyurethane resin, polypropylene resin, acrylic resin, and methacrylic resin.

18 Claims, 17 Drawing Sheets

(51) Int. Cl.

| | |
|---|---|
| ***B41M 5/41*** | (2006.01) |
| ***B41M 5/42*** | (2006.01) |
| ***B41J 3/00*** | (2006.01) |
| ***B41J 31/00*** | (2006.01) |

(52) U.S. Cl.
CPC ..... *B41M 2205/36* (2013.01); *B41M 2205/38* (2013.01)

(56) References Cited

FOREIGN PATENT DOCUMENTS

| | | | | |
|---|---|---|---|---|
| EP | 1002661 | A1 | | 5/2000 |
| EP | 1346838 | A2 | | 9/2003 |
| JP | H08-118830 | A | | 5/1996 |
| JP | 2000-303374 | A | | 10/2000 |
| JP | 2000303374 | A | * | 10/2000 |
| JP | 2010-005969 | A | | 1/2010 |
| WO | 2015-046423 | A1 | | 4/2015 |

* cited by examiner

FIRST COMPARATIVE EXAMPLE

FIRST COMPARATIVE EXAMPLE

SECOND COMPARATIVE EXAMPLE

SECOND COMPARATIVE EXAMPLE

THERMAL TRANSFER INK RIBBON FOR CARTRIDGE AND PRINTING APPARATUS

CROSS REFERENCE TO RELATED APPLICATION

This application claims priority from Japanese Patent Application No. 2015-216678 filed Nov. 4, 2015. The entire content of the priority application is incorporated herein by reference.

TECHNICAL FIELD

The present disclosure relates to a thermal transfer ink ribbon used for printing, a ribbon cartridge provided with the thermal transfer ink ribbon, and a printing device that prints using the thermal transfer ink ribbon.

BACKGROUND

Thermal transfer ink ribbons used for printing are well known in the art. This thermal transfer ink ribbon (thermal transfer recording medium) includes, in order from one side of a thickness direction to the other side, a ribbon base layer (base), a release layer (removal layer), an ink layer (coloring layer), an anchor layer (vapor-deposited layer), a metallic layer (metal-deposition layer), and an adhesive layer.

SUMMARY

In the conventional technology described above, the anchor layer is interposed between the ink layer and metallic layer to ensure a strong bond is formed between the two layers. However, this anchor layer increases the overall thickness dimension of the thermal transfer ink ribbon and may also lead to a higher manufacturing cost. Further, interposing the anchor layer between these two layers may decrease the lustrous appearance of the printing results and may worsen heat conductivity in the ribbon.

It is therefore an object of the disclosure to provide a thermal transfer ink ribbon having a smaller overall thickness dimension than the conventional thermal transfer ink ribbon and that costs less to manufacture, while avoiding a decrease in the luster of printing results and a decrease in heat conductivity. It is another object of the present invention to provide a ribbon cartridge that houses the thermal transfer ink ribbon, and a printing device provided with the ribbon cartridge.

According to one aspect, the disclosure provides a thermal transfer ink ribbon including a backcoat layer, a ribbon base layer formed on the backcoat layer, a release layer formed on the ribbon base layer and containing resin and wax, an ink layer formed on the release layer and containing a first resin and a second resin, an aluminum layer formed on the ink layer, and an adhesive layer formed on the aluminum layer and containing resin and wax. The first resin is transparent or translucent and contains at least one of polyester resin, styrene-acrylic resin, and polyethylene resin. The second resin is transparent or translucent and contains at least one of polyurethane resin, polypropylene resin, acrylic resin, and methacrylic resin.

According to another aspect, the disclosure provides a thermal transfer ink ribbon including a backcoat layer, a ribbon base layer formed on the backcoat layer, a release layer formed on the ribbon base layer and containing resin and wax, an ink layer formed on the release layer and containing a first resin being transparent or translucent and a second resin being transparent or translucent, an aluminum layer formed on the ink layer, and an adhesive layer formed on the aluminum layer and containing resin and wax. The second resin has an acid value lower than that of the first resin and has a melting point lower than that of the first resin.

BRIEF DESCRIPTION OF THE DRAWINGS

The particular features and advantages of the disclosure will become apparent from the following description taken in connection with the accompanying drawings, in which.

DETAILED DESCRIPTION

<First Embodiment>

Figure 1:
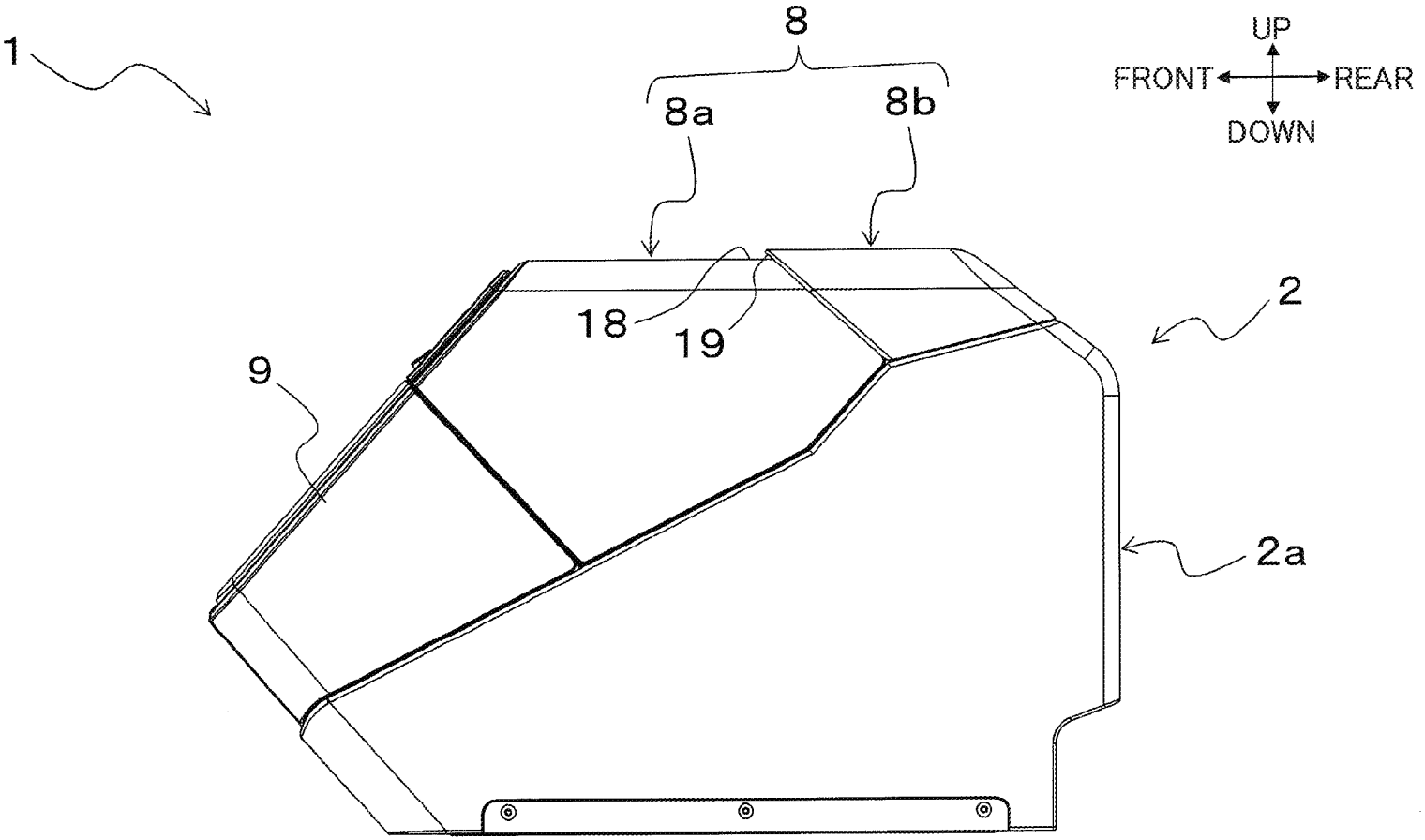
FIG. 1 is a tape printer according to a first embodiment.

A tape printer according to a first embodiment will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the tape printer is disposed in an orientation in which it is intended to be used.

<General Configuration of Tape Printer>

The general configuration of a tape printer according to the first embodiment will be described with reference to FIGS. 1 through 4.

In FIGS. 1 through 4, a tape printer 1 (corresponding to the printing device) has a housing 2 that constitutes the outer enclosure of the device, a rear-side opening/closing part 8, and a front-side opening/closing cover 9.

The housing 2 includes a housing body 2*a*, a first accommodating section 3 provided in the rear side of the housing body 2*a*, and a second accommodating section 4 and a third accommodating section 5 provided in the front side of the housing body 2*a*.

The rear-side opening/closing part 8 is connected to an upper portion on the rear side of the housing body 2*a* and can be opened and closed thereon. The rear-side opening/closing part 8 can open and close the region above the first accommodating section 3 by pivoting. The rear-side opening/closing part 8 is configured of a first opening/closing cover 8*a*, and a second opening/closing cover 8*b*.

The first opening/closing cover 8*a* can open and close the region above the front side of the first accommodating section 3 by pivoting about a prescribed rotational axis K1 positioned in the upper region of the rear side of the housing body 2*a*. A head retaining part 10 is provided inside the first opening/closing cover 8*a* (see FIG. 3). A thermal head 11 (corresponding to the printer) is provided in the head retaining part 10. A conveying roller 12 (corresponding to the conveyer) is disposed in the housing body 2*a*. When the first opening/closing cover 8*a* pivots about the rotational axis K1, the thermal head 11 provided in the head retaining part 10 can be moved relatively closer to or farther away from the conveying roller 12 provided in the housing body 2*a*.

The second opening/closing cover 8*b* is disposed to the rear side of the first opening/closing cover 8*a* described above. The second opening/closing cover 8*b* can open and close the region above the rear side of the first accommodating section 3 separately from the opening and closing action of the first opening/closing cover 8*a* described above by pivoting around a prescribed rotational axis K2 positioned at the upper end of the rear side constituting the housing body 2*a*.

The first opening/closing cover 8*a* and second opening/closing cover 8*b* are configured such that, when each is closed, an outer peripheral part 18 of the first opening/closing cover 8*a* and an edge part 19 of the second opening/closing cover 8*b* substantially contact each other and cover nearly the entire area above the first accommodating section 3.

The front-side opening/closing cover 9 is connected to the upper portion on the front side of the housing body 2*a* so as to be capable of opening and closing thereon. The front-side opening/closing cover 9 can open and close the region above the second accommodating section 4 by pivoting about a prescribed rotational axis K3 positioned at the upper end of the front side constituting the housing body 2*a*. Specifically, the front-side opening/closing cover 9 can rotate from a closed position (the state shown in FIGS. 1 and 3) to cover the region above the second accommodating section 4 to an open position (the state in FIG. 4) to expose the region above the second accommodating section 4.

At this time, a tape cartridge TK is detachably mounted in the housing body 2*a* at a first prescribed position 13. The tape cartridge TK in the first prescribed position 13 is beneath the front-side opening/closing cover 9 when the front-side opening/closing cover 9 is in the closed state. The tape cartridge TK includes a first roll R1 that is formed as a winding about an axial center O1, and a coupling arm 16.

The first roll R1 is supported on the rear side of the tape cartridge TK by the coupling arm 16 and is rotatable when the tape cartridge TK is mounted in the housing body 2*a*. The first roll R1 has an elongated fabric tape 153 (corresponding to the recording medium and the satin-weave fabric medium) that is pre-wound about the axial center O1 and that is consumed when paid out from the first roll R1 for printing. Note that the fabric tape 153 provided as the first roll R1 described above is omitted from the drawings when expedient (to avoid complexities in illustration) and only a substantially circular roll flange part arranged so as to contact both widthwise edges of the fabric tape 153 is shown. In such cases, the roll flange part is designated with the reference number "R1" for convenience.

As the tape cartridge TK is mounted in the housing body 2*a*, the first accommodating section 3 receives the first roll R1 from above, and the first roll R1 is accommodated in the first accommodating section 3 such that the axial center O1 about which the fabric tape 153 is wound is oriented in the left-right direction. While accommodated in the first accommodating section 3 (while the tape cartridge TK is in the mounted state), the first roll R1 rotates in a prescribed rotating direction (a direction A in FIG. 2) in the first accommodating section 3 to pay out the fabric tape 153.

Figure 2:
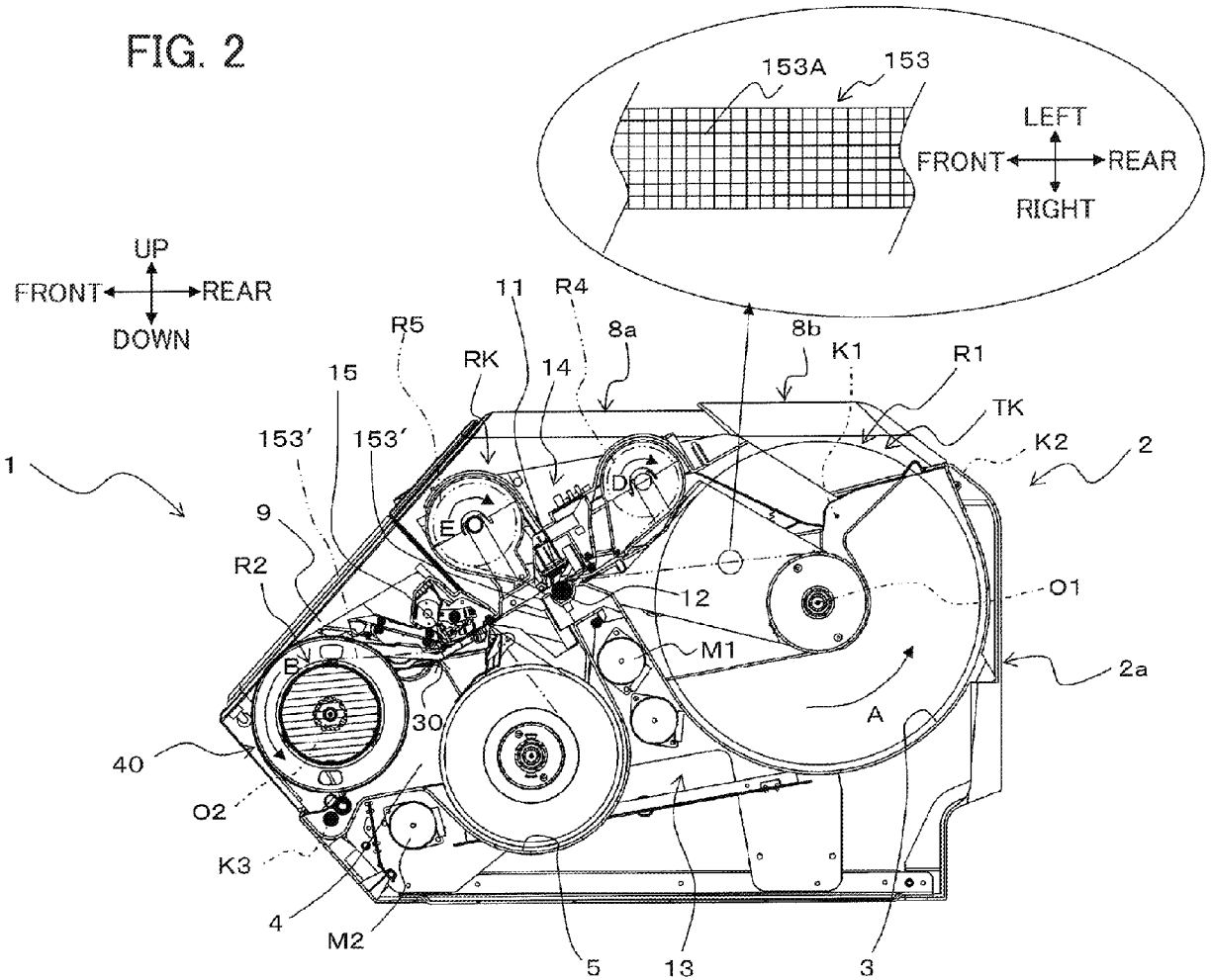
FIG. 2 illustrates an internal structure of the tape printer according to the first embodiment.
Figure 3:
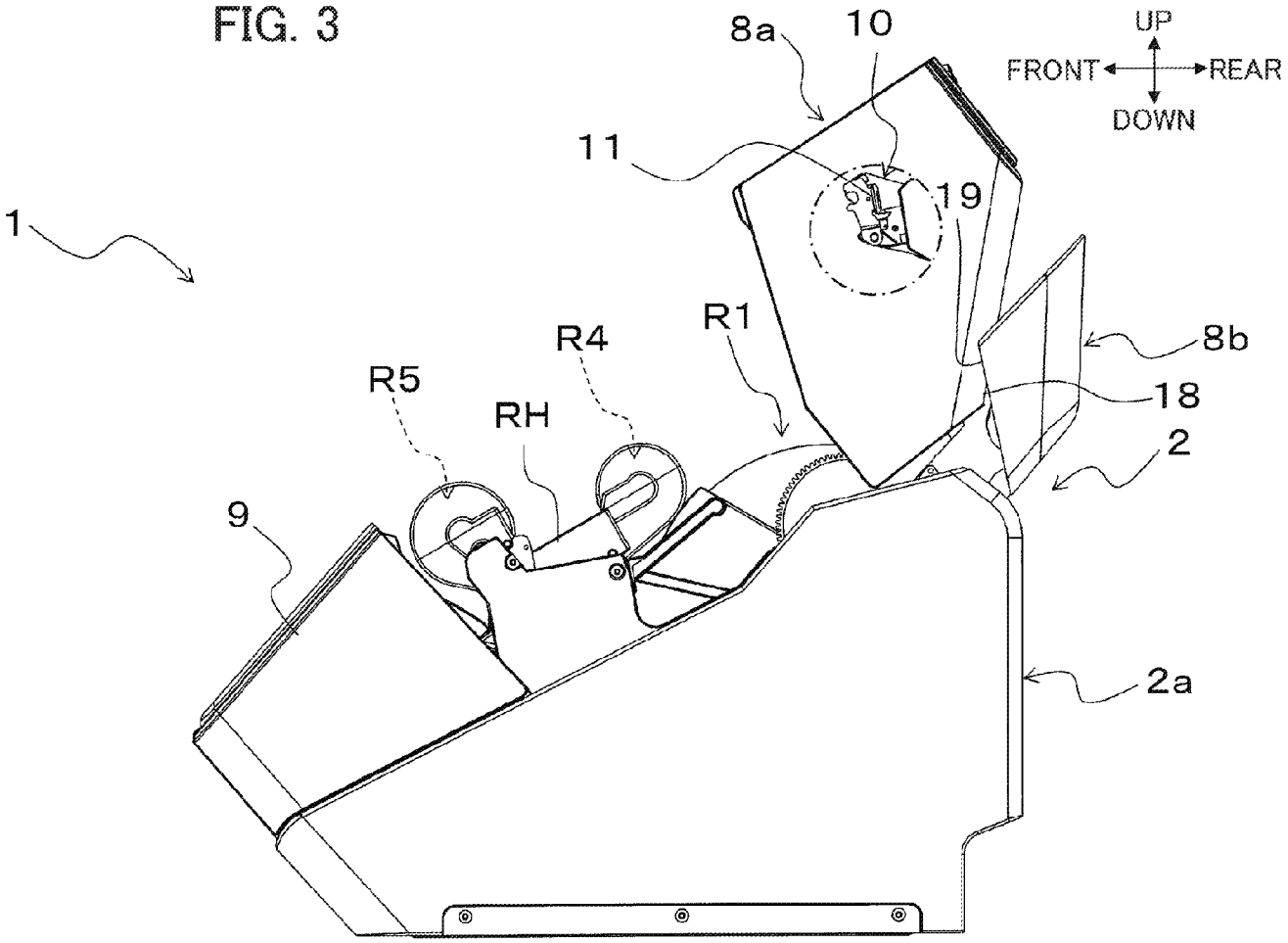
FIG. 3 is a right side view of the tape printer according to the first embodiment in a condition where a first and second opening/closing covers are opened.
Figure 4:
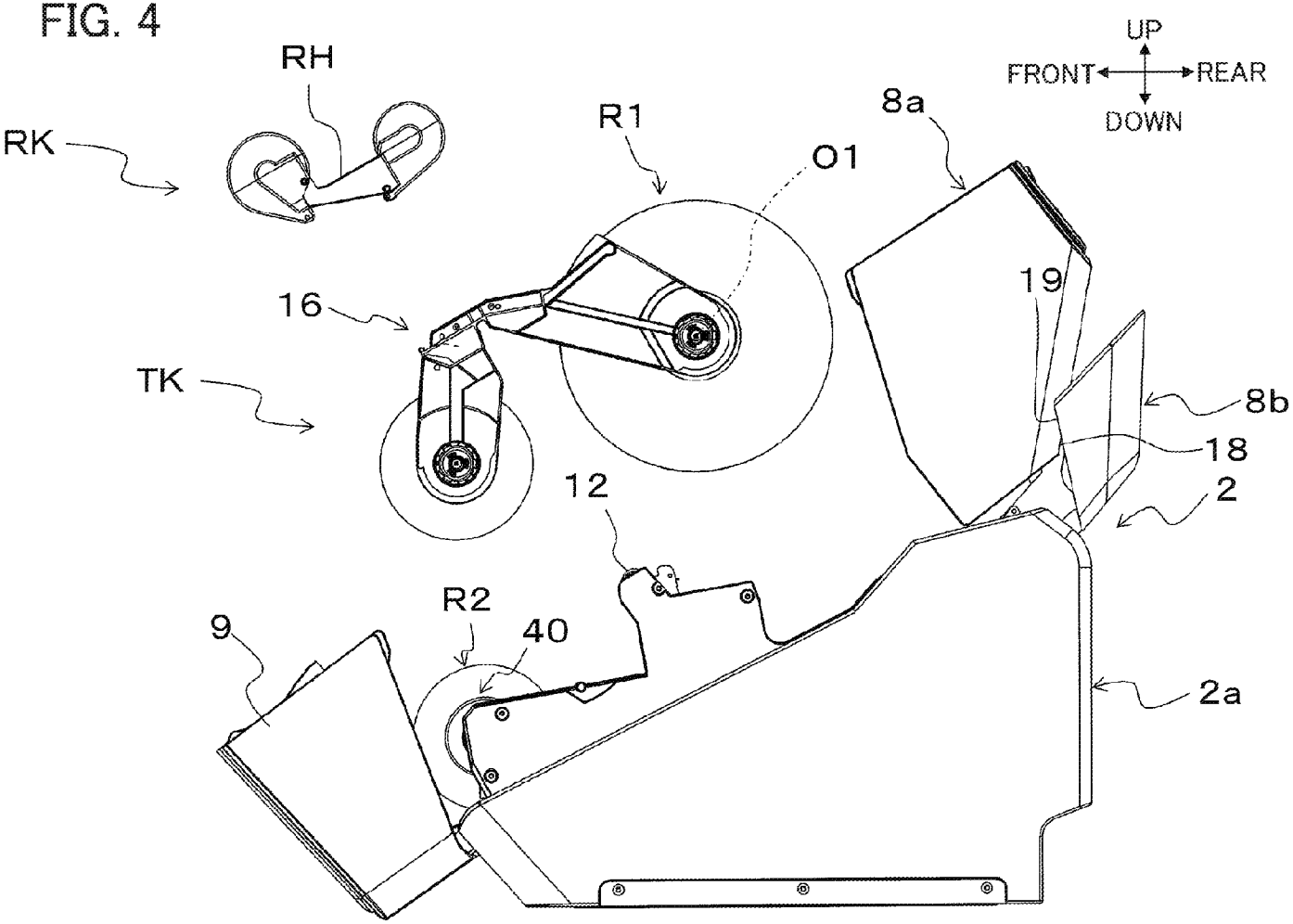
FIG. 4 is an exploded side view of the tape printer according to the first embodiment in a condition where the first and second opening/closing covers are opened and a tape cartridge and a ribbon cartridge are detached.

As shown in the enlarged view of FIG. 2, a surface on one side of the fabric tape 153 described above serves as a printing surface 153A on which the thermal head 11 prints. That is, the tape printer 1 performs desired printing in accordance with print data received from a personal computer (PC) 217 (see FIG. 5 described later) using the thermal head 11 to thermally transfer ink from an ink ribbon IB (described later) onto the printing surface 153A of the fabric tape 153. This will be described later in greater detail. In the preferred embodiment, the fabric tape 153 is formed by satin-weaving (l-end satin, for example) a warp thread extending in a tape longitudinal direction and a weft thread extending in a tape latitudinal direction. In this example, the above warp thread and weft thread are formed of polyester, making the fabric tape 153 polyester satin. Here, the printing surface 153A described above constitutes the surface of the fabric tape 153 on the thickness-direction side that has more warp thread exposed than weft thread owing to the satin weave described above. This satin weave is used to produce relatively few interlacings in the printing surface 153A of the fabric tape 153, making the printing surface 153A relatively smooth.

Further, the conveying roller 12 described above is disposed on the upper side of the housing body 2*a* between the first accommodating section 3 and third accommodating section 5. The conveying roller 12 is driven by a conveying motor M1 provided in the housing body 2*a* via a gear mechanism (not shown). When driven, the conveying roller 12 conveys the fabric tape 153 fed off the first roll R1 accommodated in the first accommodating section 3 such that the width dimension of the tape is oriented in the left-right direction.

The head retaining part 10 that is disposed in the first opening/closing cover 8*a* is also provided with the thermal head 11 mentioned above. The thermal head 11 is disposed at a position in the head retaining part 10 that confronts the conveying roller 12 from above when the first opening/closing cover 8*a* is in the closed state. In this state, the fabric tape 153 conveyed by the conveying roller 12 is pinched between the thermal head 11 and the conveying roller 12. Hence, the thermal head 11 and conveying roller 12 are arranged so as to confront each other vertically when the first opening/closing cover 8*a* is in the closed state. The thermal head 11 prints on the printing surface 153A of the fabric tape 153 pinched between the thermal head 11 and conveying roller 12 using the ink ribbon IB described later to produce a printed fabric tape 153'.

To perform this printing operation, a ribbon cartridge RK is detachably mounted in the housing body 2*a* at a second prescribed position 14. When the ribbon cartridge RK is in the prescribed position 14 and the first opening/closing cover 8*a* is in the closed state, the ribbon cartridge RK is positioned beneath the first opening/closing cover 8*a* and above the tape cartridge TK. The ribbon cartridge RK includes a housing RH (corresponding to the support member), a ribbon supply roll R4 (corresponding to the ink ribbon roll), and a ribbon take-up roll R5.

The ribbon supply roll R4 is rotatably supported by the housing RH on the rear side of the ribbon cartridge RK and includes the ink ribbon IB (corresponding to the thermal transfer ink ribbon; see FIG. 8 described later) wound around a prescribed axial center. By rotating in a prescribed rotating direction (a direction D in FIG. 2) while the ribbon cartridge RK is in the mounted state, the ribbon supply roll R4 pays out the unused ink ribbon IB in order for the thermal head 11 to perform printing.

The ribbon take-up roll R5 is rotatably supported by the housing RH on the front side of the ribbon cartridge RK. By rotating in a prescribed rotating direction (a direction E in FIG. 2) while the ribbon cartridge RK is in the mounted state, the ribbon take-up roll R5 takes up the used ink ribbon IB.

Further, a ribbon take-up roller (not shown) is disposed on the first opening/closing cover 8*a* at a position downstream of the thermal head 11 in the tape conveying direction. The ribbon take-up roller guides the used ink ribbon IB to the ribbon take-up roll R5.

In other words, the ink ribbon IB fed out from the ribbon supply roll R4 is positioned on the thermal head 11 side of the fabric tape 153 that is pinched between the thermal head 11 and conveying roller 12 and contacts the bottom portion of the thermal head 11. Printing is executed when heat applied by the thermal head 11 causes some layers of the ink ribbon IB (described later in greater detail) to be transferred onto the printing surface 153A of the fabric tape 153. Subsequently, the used ink ribbon IB is taken up on the ribbon take-up roll R5 while being guided by the ribbon take-up roller described above.

Further, the printed fabric tape 153' described above is wound around an outer circumferential surface of a take-up mechanism 40, thereby forming a second roll R2. Specifically, the take-up mechanism 40 for sequentially taking up the printed fabric tape 153' is received in the second accommodating section 4 from above. The take-up mechanism 40 is accommodated in the second accommodating section 4 so as to be supported rotatably about an axis O2, about which the printed fabric tape 153' is wound. The axis O2 is oriented in the left-right direction. While the take-up mechanism 40 is accommodated in the second accommodating section 4, a take-up roller M2 disposed in the housing body 2*a* drives the take-up mechanism 40 via a gear mechanism. When driven by the take-up roller M2, the take-up mechanism 40 rotates in a prescribed rotating direction (a direction B in FIG. 2) in the second accommodating section 4 so that the printed fabric tape 153' is taken up on the outer circumferential surface of the take-up mechanism 40 in sequential layers that form the second roll R2 described above. Note that the printed fabric tape 153' constituting the second roll R2 has been expediently omitted from the drawings (to avoid complexities in illustration) and only a substantially circular roll flange part arranged so as to contact both widthwise edges of the printed fabric tape 153' is shown in the drawings. In such cases, the roll flange part is designated with the reference number "R2."

<Overview of Operations of Tape Printer>

Next, an overview of the operations of the tape printer 1 will be described.

When the tape cartridge TK is mounted in the first prescribed position 13, the first roll R1 positioned on the rear side of the tape cartridge TK is accommodated in the first accommodating section 3 and the front-side portion of the tape cartridge TK is accommodated in the third accommodating section 5. Further, the take-up mechanism 40 for forming the second roll R2 is accommodated in the second accommodating section 4.

At this time, the conveying roller 12 is driven to convey the fabric tape 153, paid out from the rotating first roll R1 accommodated in the first accommodating section 3, in a forward direction. As the fabric tape 153 is conveyed, the thermal head 11 prints on the printing surface 153A of the fabric tape 153, producing the printed fabric tape 153'. The printed fabric tape 153' is conveyed farther forward and is introduced into the second accommodating section 4. The printed fabric tape 153' is wound around the outer circumferential surface of the take-up mechanism 40 in the second accommodating section 4, forming the second roll R2. At this time, a cutter mechanism 30 disposed on the front-side opening/closing cover 9 at a position rearward of the second roll R2, i.e., upstream of the second roll R2 in the tape conveying direction, cuts the printed fabric tape 153'. In this way, the tape printer 1 can cut the printed fabric tape 153' being wound into the second roll R2 at a timing preferred by the user, and the user can retrieve the second roll R2 from the second accommodating section 4 following the cutting operation.

Note that the tape printer 1 may be provided with a chute 15 for switching the conveying path for the printed fabric tape 153' between a position facing toward the second roll R2 and a position facing toward an outlet (not shown) provided on the second opening/closing cover 8*b* side of the housing 2, for example. Hence, by switching the chute 15 using a lever (not shown) in order to change the tape conveying path to the position facing the outlet, the user can discharge the printed fabric tape 153' from the housing 2 directly through the outlet (without having the printed fabric tape 153' wound about the take-up mechanism 40 inside the second accommodating section 4).

<Control System>

Next, the control system of the tape printer 1 will be described with reference to FIG. 5.

Figure 5:
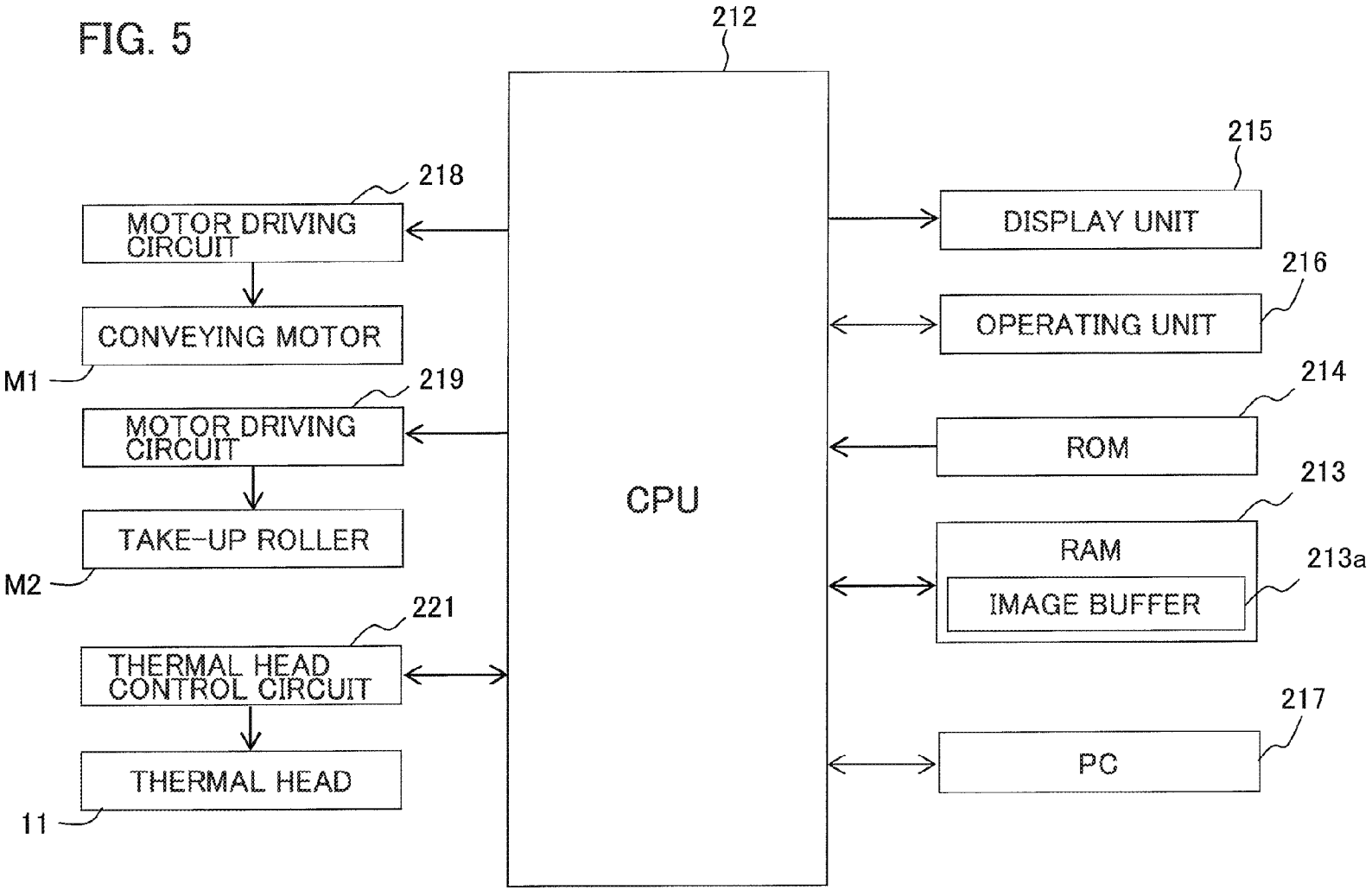
FIG. 5 is a functional block diagram illustrating a control system of the tape printer according to the first embodiment.

As shown in FIG. 5, the tape printer 1 is provided with a CPU 212 (corresponding to the controller). The CPU 212 is connected to a RAM 213, a ROM 214, a display unit 215, and an operating unit 216. The CPU 212 performs signal processing in accordance with a program pre-stored in the ROM 214 while utilizing a temporary storage function of the RAM 213, thereby controlling overall operations of the tape printer 1. The CPU 212 is also connected to a motor driving circuit 218 that controls driving of the conveying motor M1, a motor driving circuit 219 that controls driving of the take-up roller M2, and a thermal head control circuit 221 that controls energizing of heating elements in the thermal head 11.

The RAM 213 is provided with an image buffer 213*a* for expanding print data from an image data format received from the PC 217 mentioned earlier (or generated through operations on the operating unit 216) into dot pattern data for printing the printing surface 153A of the fabric tape 153, and stores the dot pattern data. The CPU 212 controls the thermal head 11 through the thermal head control circuit 221 to print the printing surface 153A based on print data stored in the image buffer 213*a* while controlling the conveying roller 12 to convey the fabric tape 153, according to a suitable control program stored in the ROM 214. In the preferred embodiment, the CPU 212 controls the conveying roller 12 and the thermal head 11 in conjunction with or interlocking with each other according to a well-known technique for maintaining the components in synchronization with each other in order to print the fabric tape 153 at a relatively high speed, e.g., between 100 and 200 mm/sec (millimeters per second) inclusive.

<Features of First Embodiment>

The tape printer 1 described above prints on the printing surface 153A of the fabric tape 153 using the thermal head 11 to thermally transfer ink from the ink ribbon IB. In thermal transfer printing using the ink of the ink ribbon IB, the thermal head 11 applies heat to melt the ink, causing melted ink to be transferred on the printing surface 153A of the fabric tape 153. The ink ribbon IB in the preferred embodiment is used for printing in a gold color. A feature of the embodiment is the configuration of the ink ribbon IB for use in printing a gold color. This configuration can reduce the overall thickness dimension of the ink ribbon IB and can decrease the manufacturing cost of the ink ribbon IB. The configuration can also avoid loss of metallic luster in the appearance of the printing results and can prevent a decrease in heat conductivity. These features will be described below in greater detail.

<Ink Ribbon According to Comparative Example>

Before describing the ink ribbon IB of the preferred embodiment, a comparative example of an ink ribbon will be described.

<Ink Ribbon According to First Comparative Example>

Figure 6A:
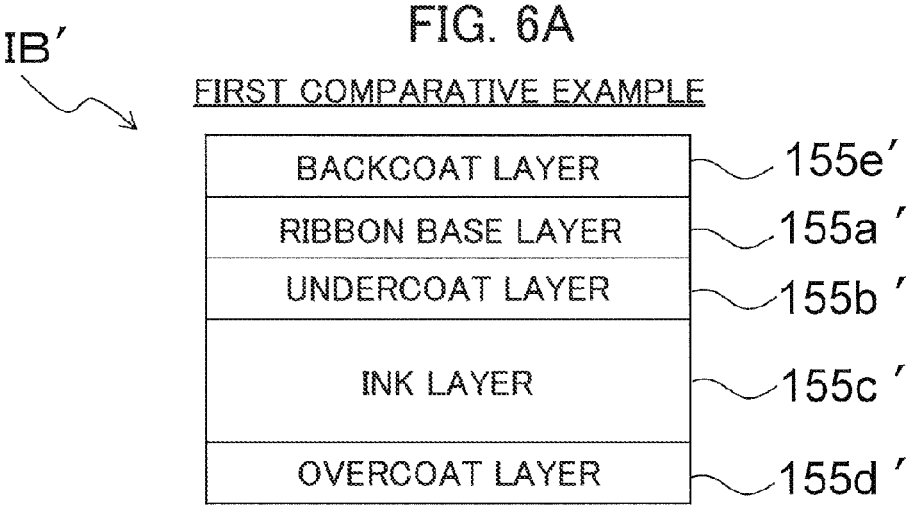
FIG. 6A is a schematic view showing in detail a layered structure of an ink ribbon according to a first comparative example.
Figure 6B:
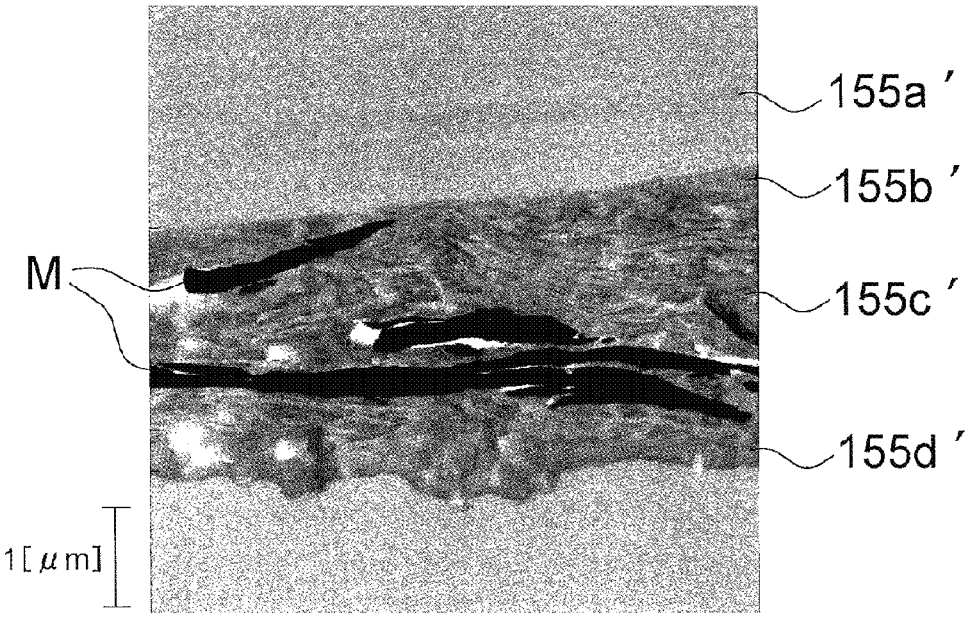
FIG. 6B is a picture of the layered structure of the ink ribbon according to the first comparative example.

FIGS. 6A and 6B show in detail the layered structure of an ink ribbon according to a first comparative example through a conceptual drawing and a sectional photo, respectively.

As shown in FIGS. 6A and 6B, an ink ribbon IB' according to the first comparative example has a five-layer structure that includes, in order from one side in the thickness direction (the top side of FIG. 6A) to the other side (the bottom side of FIG. 6A), a backcoat layer 155*e*', a ribbon base layer 155*a*', an undercoat layer 155*b*', an ink layer 155*c*', and an overcoat layer 155*d*'. The backcoat layer 155*e*' functions as a heat-resistant coating. The undercoat layer 155*b*' is a release layer that melts when subjected to a prescribed amount of heat and separates from the ribbon base layer 155*a*'. The ink layer 155*c*' is a coloring layer. The overcoat layer 155*d*' is an adhesive layer that adheres to a transfer-receiving object. Here, a metal powder M such as a copper powder, and a colorant (dye or pigment) are added to the ink layer 155*c*' in order to give the printed images the visual appearance of a gold color (metallic luster).

Figure 7:
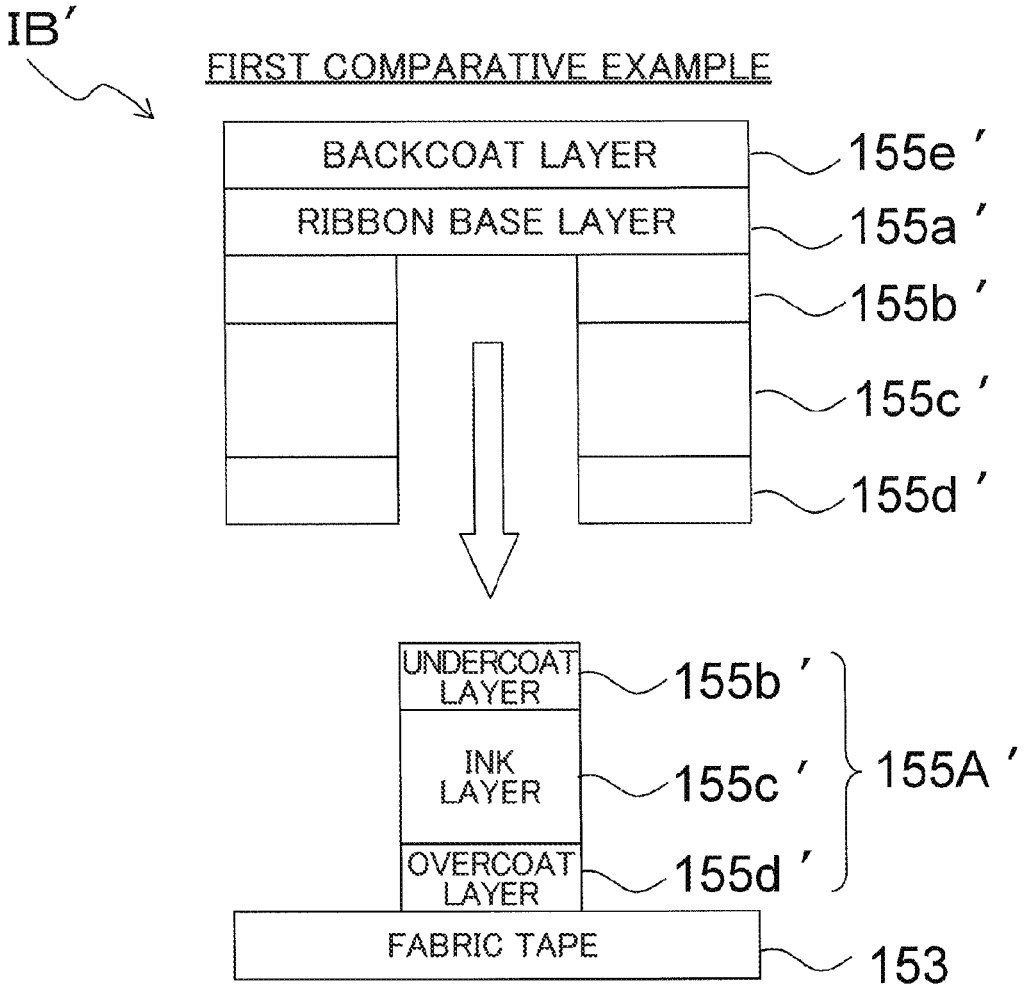
FIG. 7 illustrates behavior of the ink ribbon transferring to a fabric tape according to the first comparative example.

When using the ink ribbon IB' according to the first comparative example having the structure described above, the undercoat layer 155*b*' melts when subjected to heat applied by the thermal head 11 and separates from the ribbon base layer 155*a*'. As a result, a transfer layer 155A' integrally composed of the undercoat layer 155*b*', ink layer 155*c*', and overcoat layer 155*d*' separates from the ribbon base layer 155*a*', as illustrated in FIG. 7. The transfer layer 155A' is then transferred onto the fabric tape 153, which is the transfer-receiving object, such that the overcoat layer 155*d*' in the transfer layer 155A is deposited on the printing surface 153A of the fabric tape 153. Through this process, a desired print image is formed by the transfer layer 155A' on the printing surface 153A of the fabric tape 153. Owing to the metal powder M added to the ink layer 155*c*', the printed image formed on the printing surface 153A of the fabric tape 153 can be given a lustrous metallic appearance.

<Ink Ribbon According to Second Comparative Example>

Figure 8A:
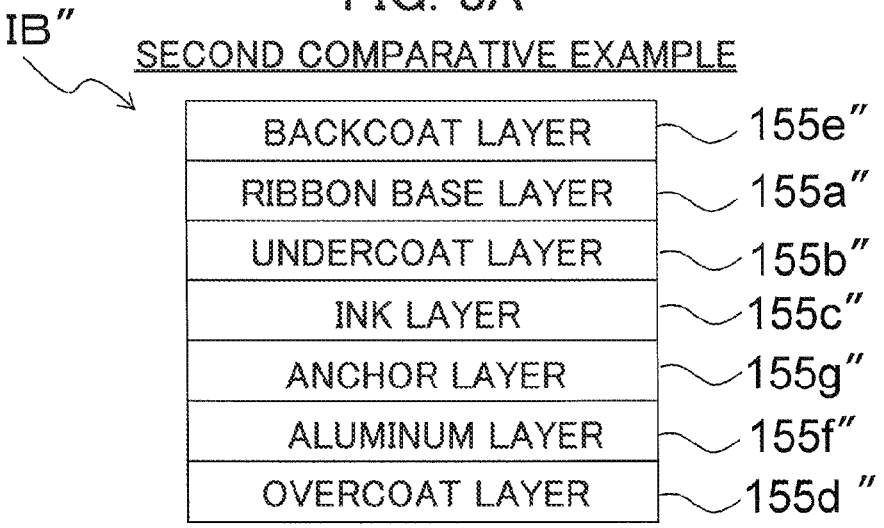
FIG. 8A is a schematic view showing in detail a layered structure of an ink ribbon according to a second comparative example.

FIG. 8A is a conceptual view showing in detail the layered structure of an ink ribbon according to a second comparative example.

As shown in FIG. 8A, an ink ribbon IB" according to the second comparative example has a seven-layer structure that includes, in order from one side in the thickness direction (the top of the ink ribbon IB" in FIG. 8A) to the other side (the bottom in FIG. 8A), a backcoat layer 155*e*", a ribbon base layer 155*a*", an undercoat layer 155*b*", an ink layer 155*c*", an anchor layer 155*g*", an aluminum layer 155*r*, and an overcoat layer 155*d*". The backcoat layer 155*e*" functions as a heat-resistant coating. The undercoat layer 155*b*" is a release layer that melts when subjected to a prescribed amount of heat and separates from the ribbon base layer 155*a*". The ink layer 155*c*" is a coloring layer. The overcoat layer 155*d*" is an adhesive layer that adheres to the transfer-receiving object. Here, in order to give the printed image the appearance of a gold color (metallic luster), the ink ribbon IB" is provided with the aluminum layer 155*f*" that produces a silver color, and a yellow colorant (dye or pigment), for example, is added to the ink layer 155*c*". In addition, the anchor layer 155*g*" is provided between the ink layer 155*c*" and aluminum layer 155*f*" to ensure strong adhesion between the two layers.

Figure 8B:
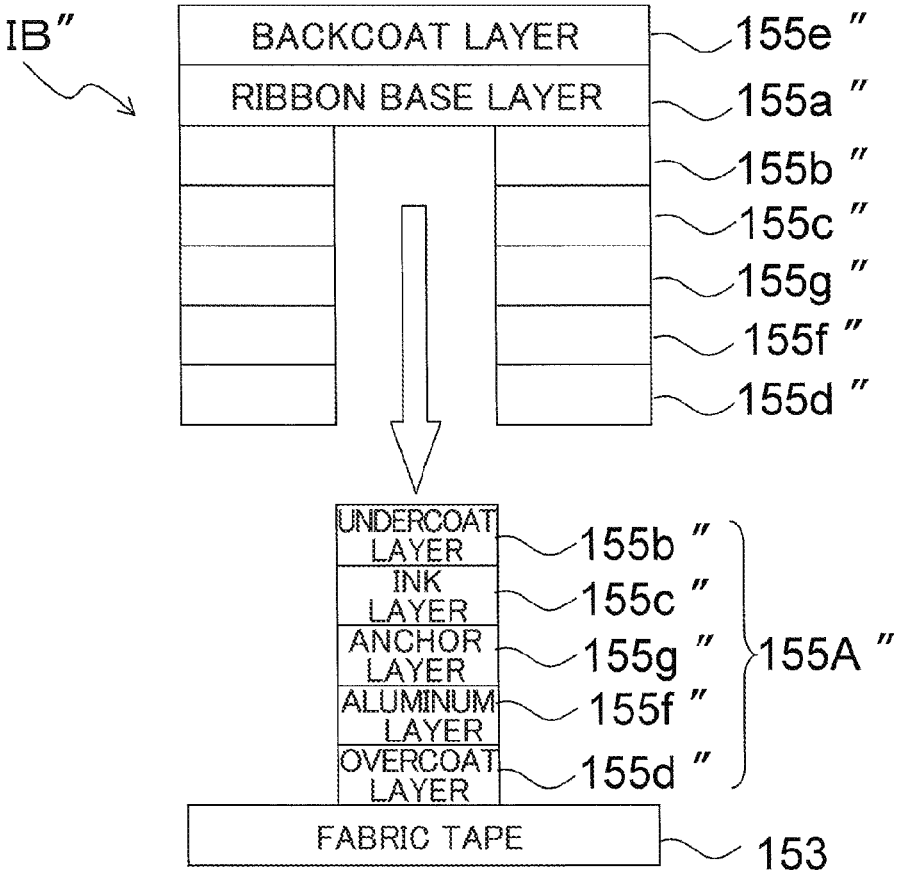
FIG. 8B is a picture of the layered structure of an ink ribbon according to the second comparative example.

When printing with the ink ribbon IB" according to the second comparative example having the structure described above, the undercoat layer 155*b*" melts when subjected to heat applied by the thermal head 11 and separates from the ribbon base layer 155*a*". As a result, a transfer layer 155A" integrally composed of the undercoat layer 155*b*", ink layer 155*c*", anchor layer 155*g*", aluminum layer 155*f*', and overcoat layer 155*d*" separates from the ribbon base layer 155*a*", as illustrated in FIG. 8B. The transfer layer 155A" is transferred onto the fabric tape 153, which is the transfer-receiving object, and the overcoat layer 155*d*" of the transfer layer 155A" is deposited on the printing surface 153A of the fabric tape 153. Through this process, a desired print image is formed by the transfer layer 155A" on the printing surface 153A of the fabric tape 153. The aluminum layer 155*f*" included in the print image formed by the transfer layer 155A" can give the printed image a better metallic luster than when metal powder is added to the ink layer, as in the first comparative example described above. Further, suitable color control (tone adjustment or gold coloration, for example) can be performed on the color produced by the aluminum layer 155*f*" (silver) by adding a suitable coloring agent to the ink layer 155*c*" to render a color that has the visual appearance of gold.

<Adhesion Between Ink Layer and Aluminum Layer>

Here, the metallic luster of the print image is relatively dull in appearance when adding metal powder to the ink layer, as in the first comparative example. Further, interposing the anchor layer between the ink layer and aluminum layer in order to ensure strong adhesion between the two layers, as described in the second comparative example, increases the overall thickness dimension of the ink ribbon and increases manufacturing costs. Further, the interposed anchor layer reduces the metallic luster of the print image and decreases heat conductivity. Therefore, in order to reduce the overall thickness dimension of the ink ribbon and keep down manufacturing costs and in order to avoid a loss of metallic luster and a decrease in heat conductivity, some measure must be taken in relation to the layered structure of the ink ribbon, the physical properties of each layer, and the like. In particular, sufficient measures must be taken when performing high-speed printing, as in the preferred embodiment, since heat applied by the thermal head 11 produces low printing energy. In addition, sufficient measures must be taken when using the fabric tape 153 as the transfer-receiving object, as in the preferred embodiment, since the printing surface 153A of the fabric tape 153 is irregular.

<Ink Ribbon According to Embodiment>

Figure 9A:
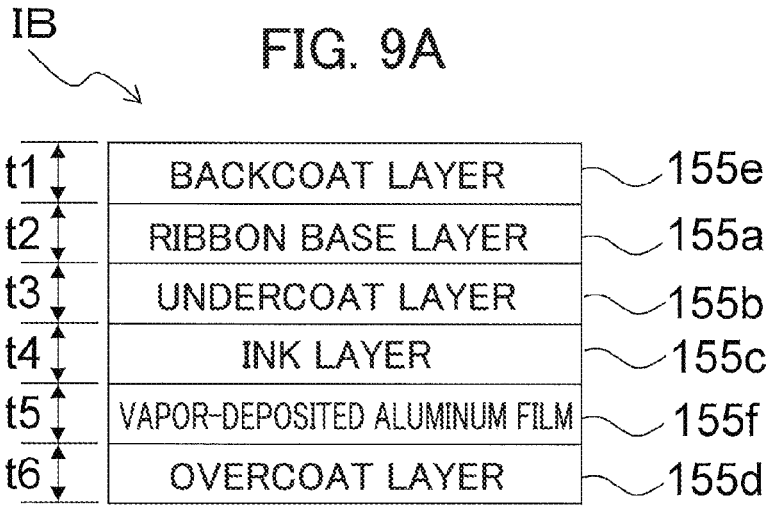
FIG. 9A is a schematic view showing in detail a layered structure of an ink ribbon according to the first embodiment.
Figure 9B:
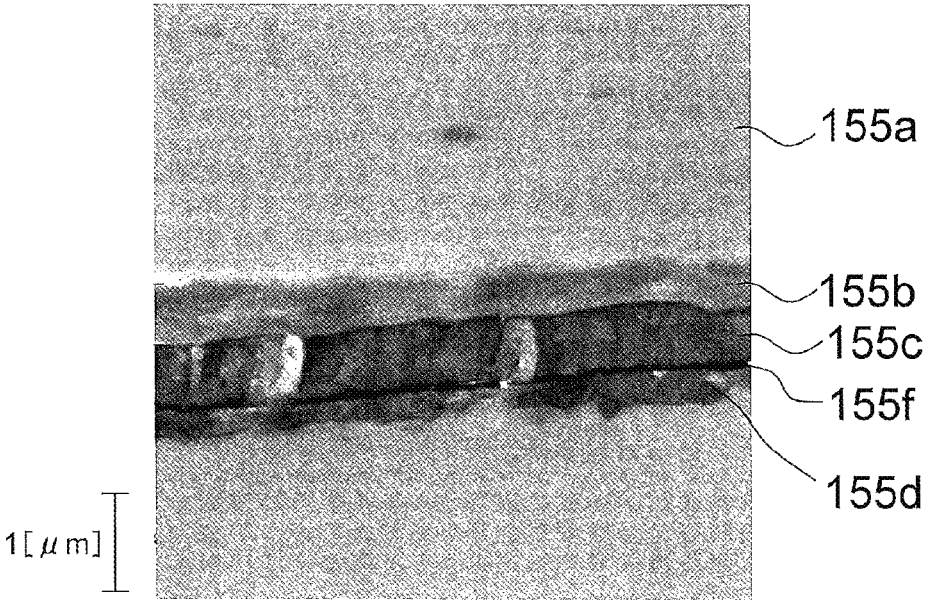
FIG. 9B is a picture of the layered structure of the ink ribbon according to the first embodiment.

As a result of independent studies, the inventors and the like of this application discovered that the overall thickness dimension of the ink ribbon could be reduced and manufacturing costs could be decreased and that a loss of metallic luster in the print image and a decrease in heat conductivity could be avoided by using the following layered structure for the ink ribbon, physical properties of each layer, and the like. Next, the ink ribbon IB of the preferred embodiment will be described. FIGS. 9A and 9B show in detail the layered structure of the ink ribbon IB according to the preferred embodiment through a conceptual diagram and cross-sectional photo, respectively.

As shown in FIGS. 9A and 9B, the ink ribbon IB has a six-layer structure that includes, in order from one side in the thickness direction (the top in FIG. 9A) to the other side (the bottom in FIG. 9A), a backcoat layer 155*e*, a ribbon base layer 155*a*, an undercoat layer 155*b*, an ink layer 155*c*, a vapor-deposited aluminum film 155*f*, and an overcoat layer 155*d*. The backcoat layer 155*e* functions as a heat-resistant coating. The undercoat layer 155*b* is a re s lease layer that melts when subjected to a prescribed amount of heat and separates from the ribbon base layer 155*a*. The vapor-deposited aluminum film 155*f* is an aluminum layer that produces a silver color. The overcoat layer 155*d* is an adhesive layer that adheres to the transfer-receiving object. Hence, the ribbon base layer 155*a* is formed adjacent to one side of the backcoat layer 155*e* in the thickness direction; the undercoat layer 155*b* is formed adjacent to one side (the lower side in FIG. 9A) of the ribbon base layer 155*a* in the thickness direction; the ink layer 155*c* is formed adjacent to one side of the undercoat layer 155*b* in the thickness direction; the vapor-deposited aluminum film 155*f* is formed adjacent to one side of the ink layer 155*c* in the thickness direction; and the overcoat layer 155*d* is formed adjacent to one side of the vapor-deposited aluminum film 155*f* in the thickness direction.

The ribbon base layer 155*a* is configured of a polyethylene terephthalate (PET) film. However, polyester films other than PET film may be used for the ribbon base layer 155*a*, such as polyethylene naphthalate (PEN) film, polyarylate (PAR) film, and polybutylene terephthalate (PBT) film, as well as various other films generally used as the base film of other ink ribbons.

The undercoat layer 155*b* and overcoat layer 155*d* include a resin component and a wax component.

The resin used in the undercoat layer 155*b* and overcoat layer 155*d* (hot melt resin) need only be one type (or two or more types mixed together) from among olefinic-based copolymer resins such as ethylene-vinyl acetate copolymer and ethylene-acrylate copolymer; elastomers such as polyamide resin, polyester resin, epoxy resin, polyurethane resin, acrylic resin, vinyl chloride resin, cellulose resin, vinyl alcohol resin, petroleum resin, phenolic resin, styrene resin, vinyl acetate resin, natural rubber, styrene-butadiene rubber, isoprene rubber, and chloroprene rubber; polyisobutylene; and polybutene, for example.

The wax used in the undercoat layer 155*b* and overcoat layer 155*d* need only be one type (or two or more types mixed together) from among natural waxes such as beeswax (animal wax), carnauba wax, candelilla wax, Japan wax, rice wax (vegetable wax), montan wax, ozocerite wax, and ceresin wax (mineral wax); petroleum waxes such as paraffin wax and microcrystalline wax; and synthetic waxes such as Fischer-Tropsch wax, polyethylene wax (hydrocarbon synthetic wax), higher fatty acid ester, fatty acid amide, ketone, amines, and hydrogen hardened oil, for example.

The vapor-deposited aluminum film 155*f* may be formed by physical vapor deposition such as vacuum deposition, sputtering, or ion plating; or chemical vapor deposition, for example.

The ink layer 155*c* includes a transparent or translucent first resin, a transparent or translucent second resin, and a yellow dye. The ink layer 155*c* will be described later in greater detail.

Figure 10:
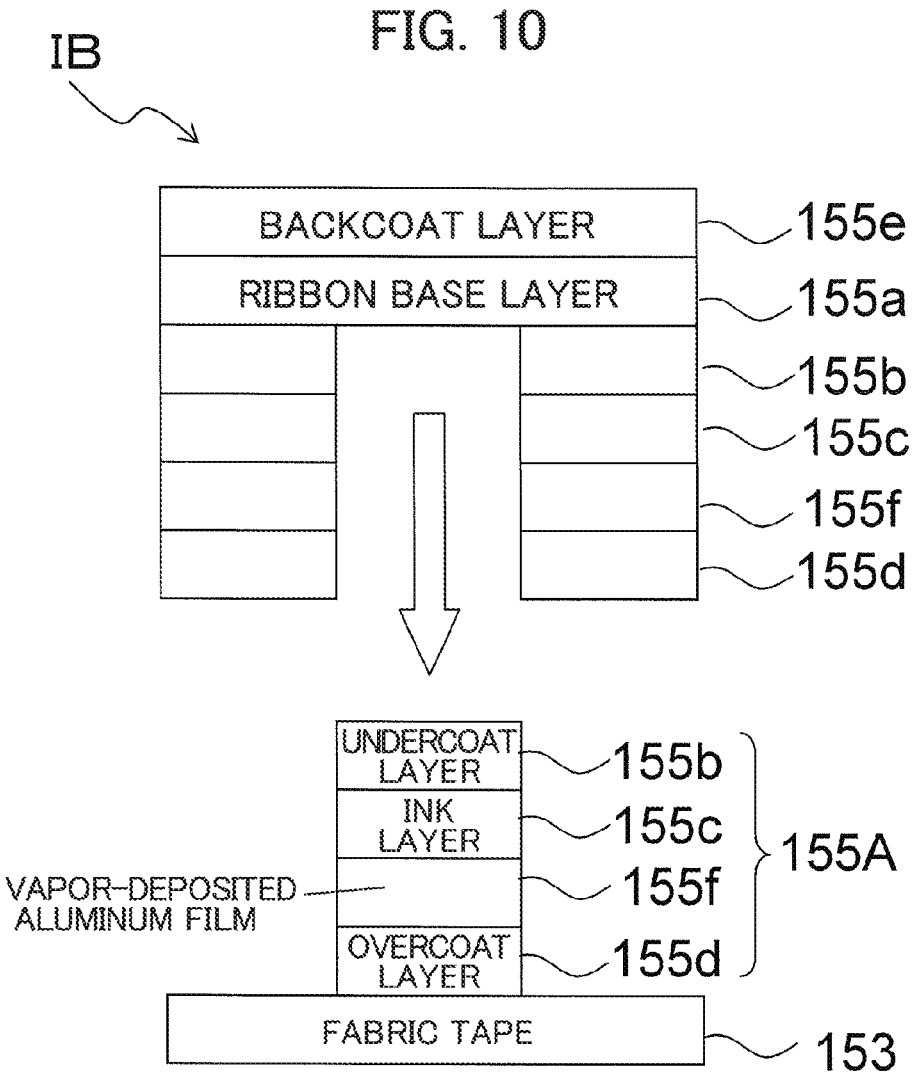
FIG. 10 illustrates behavior of the ink ribbon transferring to a fabric tape according to the first embodiment.
Figure 11:
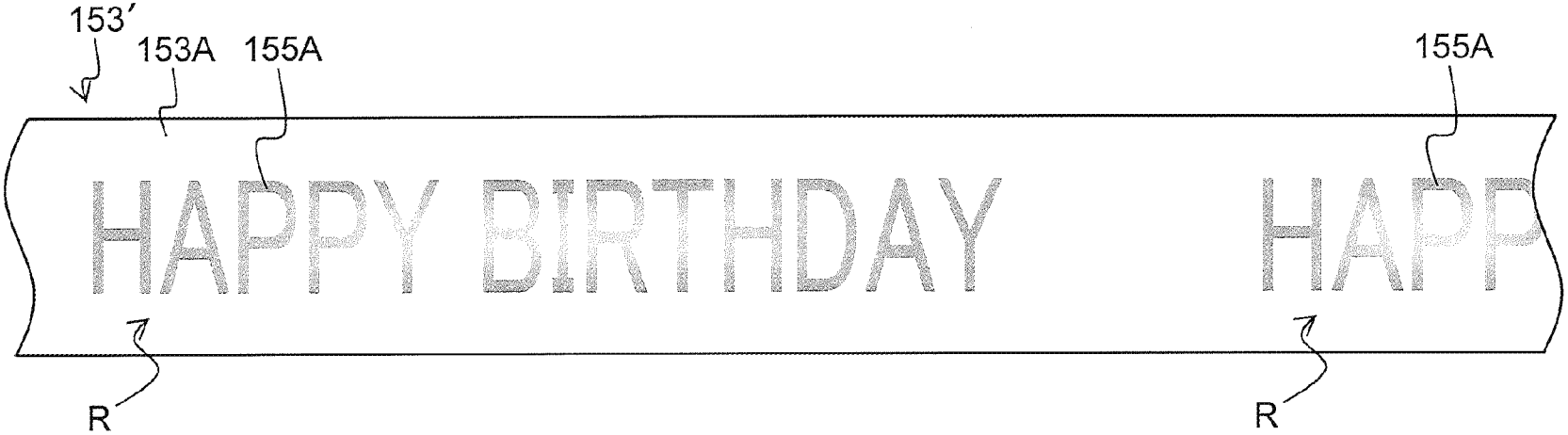
FIG. 11 is a plane view of the fabric tape according to the first embodiment.

When printing with the ink ribbon IB having the above structure, the undercoat layer 155*b* melts when subjected to heat applied by the thermal head 11 and separates from the ribbon base layer 155*a*. Consequently, a transfer layer 155A integrally composed of the undercoat layer 155*b*, ink layer 155*c*, vapor-deposited aluminum film 155*f*, and overcoat layer 155*d* separates from the ribbon base layer 155*a*, as illustrated in FIG. 10. The transfer layer 155A is transferred onto the fabric tape 153, which is the transfer-receiving object, such that the overcoat layer 155*d* of the transfer layer 155A becomes deposited on the printing surface 153A of the fabric tape 153. Through this process, a desired print image is formed by the transfer layer 155A on the printing surface 153A of the fabric tape 153. Using the ink ribbon IB of the embodiment to print an image on the printing surface 153A of the fabric tape 153 in this way produces the printed fabric tape 153' described above. Here, the vapor-deposited aluminum film 155*f* provided in the ink ribbon IB can produce a better metallic luster in the printed image formed on the printing surface 153A of the fabric tape 153 than when metal powder has been added to the ink layer, as in the first comparative example described earlier. That is, as shown in FIG. 11, a gold-colored print image R (the character string "HAPPY BIRTHDAY" in this example) formed by the transfer layer 155A on the printing surface 153A of the printed fabric tape 153' has a good quality metallic luster. Further, suitable color control (tone adjustment or gold coloration, for example) can be performed on the color produced by the vapor-deposited aluminum film 155*f* (silver) to render a visually gold color by adding yellow dye to the ink layer 155*c* as a coloring agent (red dye may also be added).

<First Resin and Second Resin>

If adhesion between the ink layer 155*c* and vapor-deposited aluminum film 155*f* in the ink ribbon IB described above is poor, the ink layer 155*c* and vapor-deposited aluminum film 155*f* may separate during a printing operation so that only the vapor-deposited aluminum film 155*f* and overcoat layer 155*d* are transferred onto the fabric tape 153, leading to difficulties in color control. Therefore, the ink layer 155*c* of the preferred embodiment includes the first resin described above that has a relatively high acid value. This first resin improves adhesion with the vapor-deposited aluminum film 155*f*, thereby avoiding separation from the same. In the preferred embodiment, the first resin includes resin having an acid value of at least 3 and no greater than 10. Using a first resin with an acid value of 3 or greater can reliably improve adhesion with the vapor-deposited aluminum film 155*f*. More specifically, the first resin includes at least one of polyester resin, styrene-acrylic resin, and polyethylene resin.

However, resins with a high acid value generally have a high melting point as well. If the ink layer 155*c* were composed solely of resins having a high melting point, the heat received by the undercoat layer 155*b* would not easily be conducted to the overcoat layer 155*d*. Consequently, the overcoat layer 155*d* may not melt adequately, reducing its ability to fix the transfer layer 155A to the fabric tape 153. Therefore, the ink layer 155*c* used in the preferred embodiment includes, in addition to the first resin, a second resin having a lower acid value and a lower melting point than the first resin. With this composition of the ink layer 155*c*, the second resin having the low melting point can facilitate heat transfer to the overcoat layer 155*d* when heat is received by the undercoat layer 155*b* so that the overcoat layer 155*d* can adequately melt to better fix the transfer layer 155A to the fabric tape 153, while the first resin having the high acid value helps achieve good adhesion with the vapor-deposited aluminum film 155*f*. In the preferred embodiment, the second resin includes a resin having a melting point of at least 90° C. (degrees centigrade) and no greater than 130° C. By using a second resin having a melting point not greater than 130° C., heat received by the undercoat layer 155*b* can be sufficiently transferred to the overcoat layer 155*d*, thereby reliably improving the ability of the overcoat layer 155*d* to fix the transfer layer 155A to the fabric tape 153. More specifically, the second resin includes at least one of polyurethane resin, polypropylene resin, acrylic resin, and methacrylic resin.

<Mixing Ratio of First Resin and Second Resing>

As a result of numerous studies, the inventors and the like of this application discovered that a worsening in adhesion between the ink layer 155*c* and vapor-deposited aluminum film 155*f* can be avoided while avoiding a decrease in the capacity of the overcoat layer 155*d* to become fixed to the fabric tape 153 by setting the mixing ratio of the first resin to the second resin between 3:7 and 8:2, inclusive. That is, setting the mixing ratio no greater than 8:2 can avoid decreased fixability to the fabric tape 153 caused by the proportion of the first resin being too high. Further, setting the mixing ratio to at least 3:7 can avoid decreased adhesion with the vapor-deposited aluminum film 155*f* caused by the proportion of the second resin being too high. In the preferred embodiment, the mixing ratio is set between 4:6 and 6:4, inclusive.

<Softening Point of Undercoat Layer>

In the preferred embodiment, the softening point of the undercoat layer 155*b* is between 10° C. and 15° C. lower than the softening point of the ink layer 155*c*. Using an undercoat layer 155*b* having a softening point at least 10° lower than the softening point of the ink layer 155*c* can avoid separation occurring between the ink layer 155*c* and vapor-deposited aluminum film 155*f* (or between the undercoat layer 155*b* and ink layer 155*c*).

<Melting Point of Overcoat Layer>

As a result of numerous studies, the inventors discovered that they could suppress a drop in the overall durability of the ink ribbon IB and could avoid a decrease in the ability of the ink ribbon IB to be fixed to the fabric tape 153 by setting the melting point of the overcoat layer 155*d* between 60° C. and 90° C., inclusive. That is, setting the melting point of the overcoat layer 155*d* to at least 60° C. can prevent the overcoat layer 155*d* from melting under high temperature conditions as a result of the melting point being too low, thereby suppressing a decrease in the overall durability of the ink ribbon IB. Further, setting the melting point of the overcoat layer 155*d* no greater than 90° C. can prevent the meltability of the overcoat layer 155*d* from worsening as a result of the melting point being too high, thereby avoiding a decrease in the ability of the ink ribbon IB to be fixed to the fabric tape 153. This effect of avoiding a decrease in the fixability of the ink ribbon IB to the fabric tape 153 is particularly significant when performing high-speed printing (when printing energy is low), as in the preferred embodiment.

<Thickness of Backcoat Layer>

In the preferred embodiment, the thickness (and specifically the coating weight or an area density) t1 of the backcoat layer 155*e* is at least 0.1 and not greater than 0.2 $g/m^2$ (grams per square meter). Setting the thickness t1 of the backcoat layer 155*e* to at least 0.1 $g/m^2$ can avoid decreased strength, decreased heat-resistance, and insufficient coverage caused by the backcoat layer 155*e* being too thin (the coating weight being too low). Further, setting the thickness t1 of the backcoat layer 155*e* no greater than 0.2 $g/m^2$ can avoid a reduction in heat transfer caused by the backcoat layer 155*e* being too thick (the coating weight being too high).

<Thickness of Ribbon Base Layer>

In the preferred embodiment, a thickness t2 of the ribbon base layer 155*a* is between 4.0 and 5.0 μm (micrometers), inclusive. Setting the thickness t2 of the ribbon base layer 155*a* to at least 4.0 μm can avoid decreased strength and decreased heat resistance caused by the ribbon base layer 155*a* being too thin. Further, setting the thickness t2 of the ribbon base layer 155*a* no greater than 5.0 μm can avoid decreased heat transfer caused by the ribbon base layer 155*a* being too thick.

<Thickness of Undercoat Layer>

In the preferred embodiment, a thickness (and specifically a coating weight or an area density) t3 of the undercoat layer 155*b* is between 0.6 and 1.0 $g/m^2$, inclusive. Setting the thickness t3 of the undercoat layer 155*b* to at least 0.6 $g/m^2$ can avoid decreased strength and insufficient coverage of the undercoat layer 155*b* caused by the undercoat layer 155*b* being too thin (the coating weight being too low). Further, setting the thickness t3 of the undercoat layer 155*b* no greater than 1.0 $g/m^2$ can avoid poorer heat transfer and decreased meltability of the undercoat layer 155*b* caused by the undercoat layer 155*b* being too thick (the coating weight being too high).

<Thickness of Ink Layer>

In the preferred embodiment, a thickness (and specifically a coating weight or an area density) t4 of the ink layer 155*c* is between 0.45 and 1.05 $g/m^2$, inclusive. Setting the thickness t4 of the ink layer 155*c* to at least 0.45 $g/m^2$ can avoid poor color control caused by the ink layer 155*c* being too thin (the coating weight being too low). Further, setting the thickness t4 of the ink layer 155*c* no greater than 1.05 g/m$^2$ can avoid decreased permeability of the ink layer 155*c* caused by the ink layer 155*c* being too thick (the coating weight being too high), thereby avoiding decreased luster as well as poorer heat transfer.

<Thickness of Vapor-Deposited Aluminum Film>

In the preferred embodiment, a thickness t5 (and specifically a coating weight) of the vapor-deposited aluminum film 155*f* is between 350 Å and 550 Å (angstroms), inclusive. Setting the thickness t5 of the vapor-deposited aluminum film 155*f* to at least 350 Å can avoid insufficient luster caused by the vapor-deposited aluminum film 155*f* being too thin. Further, setting the thickness t5 of the vapor-deposited aluminum film 155*f* no greater than 550 Å can avoid a decrease in heat transfer caused by the vapor-deposited aluminum film 155*f* being too thick.

<Thickness of Overcoat Layer>

In the preferred embodiment, a thickness (and specifically a coating weight or an area density) t6 of the overcoat layer 155*d* is between 0.1 and 0.5 g/m$^2$, inclusive. Setting the thickness t6 of the overcoat layer 155*d* to at least 0.1 g/m$^2$ can avoid sufficient fixing ability (adhesion) of the overcoat layer 155*d* to the fabric tape 153 caused by the overcoat layer 155*d* being too thin (the coating weight being too low). Further, setting the thickness t6 of the overcoat layer 155*d* no greater than 0.5 g/m$^2$ can avoid decreased meltability of the overcoat layer 155*d* caused by the overcoat layer 155*d* being too thick (the coating weight being too high), thereby avoiding decreased fixability of the overcoat layer 155*d* to the fabric tape 153.

<Effect of Embodiment>

By composing the ink layer 155*c* of the first resin and second resin described above in the preferred embodiment, the composition of the ink layer 155*c* can ensure good adhesion with the vapor-deposited aluminum film 155*f*. Accordingly, the ink ribbon IB can be configured of six layers that include the backcoat layer 155*e*, ribbon base layer 155*a*, undercoat layer 155*b*, ink layer 155*c*, vapor-deposited aluminum film 155*f*, and overcoat layer 155*d*. Thus, this composition can achieve an ink ribbon IB having a smaller overall thickness dimension than that of a thermal transfer ink ribbon having an anchor layer interposed between the ink layer and aluminum layer for ensuring good adhesion between these two layers, thereby further reducing manufacturing costs (see the second variation described above). Further, the present invention can avoid decreased luster in the appearance of the printing results and decreased heat conductivity occurring when an anchor layer is used.

A particular feature of the embodiment is the mixing ratio of the first resin to the second resin being between 3:7 and 8:2, inclusive. This composition can avoid a decreased capacity of the overcoat layer 155*d* to be fixed to the fabric tape 153 owing to the portion of the first resin being too high, while avoiding decreased adhesion between the ink layer 155*c* and vapor-deposited aluminum film 155*f* caused by the proportion of the second resin being too high.

Another particular feature of the embodiment is the acid value of the first resin being between 3 and 10, inclusive. Setting the acid value of the first resin to at least 3 can reliably improve adhesion between the ink layer 155*c* and vapor-deposited aluminum film 155*f*.

Another particular feature of the embodiment is the melting point of the second resin being between 90° C. and 130° C. Using a second resin whose melting point is no greater than 130° C. can facilitate heat transfer to the overcoat layer 155*d* when heat is received by the undercoat layer 155*b*, thereby reliably improving the ability of the overcoat layer 155*d* to be fixed to the fabric tape 153.

While the invention has been described in detail with reference to a first embodiment thereof, it would be apparent to those skilled in the art that many modifications and variations may be made therein without departing from the spirit of the invention, the scope of which is defined by the attached claims. Next, variations of the first embodiment will be described.

(1) Employing an Ink Ribbon for Printing a Silver Color

The first embodiment described an example of using an ink ribbon IB for printing in a gold color, but the present invention is not limited to this ink ribbon. For example, an ink ribbon for printing a silver color may be used instead.

Figure 12A:
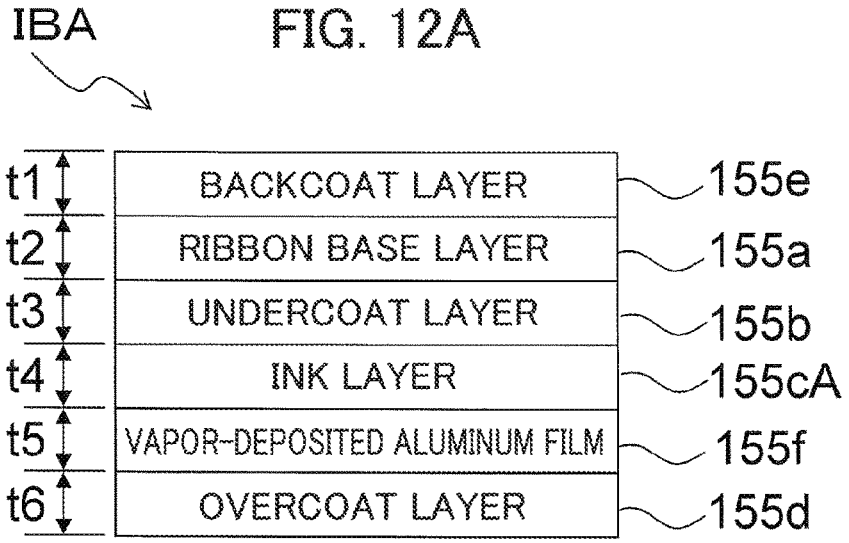
FIG. 12A is a schematic view showing in detail a layered structure of an ink ribbon for printing in silver color according to a modification.

FIG. 12A is a conceptual view showing in detail the layered structure of an ink ribbon according to a variation of the embodiment.

As shown in FIG. 12A, an ink ribbon IBA (corresponding to the thermal transfer ink ribbon) according to the variation is used for printing a silver color. The structure of the ink ribbon IBA is nearly identical to the ink ribbon IB described in the first embodiment, but the physical properties and the like of the ink layers differ. That is, an ink layer 155*c*A of the ink ribbon IBA includes a transparent or translucent first resin and a transparent or translucent second resin, but does not include the yellow dye or red dye described in the embodiment.

Figure 12B:
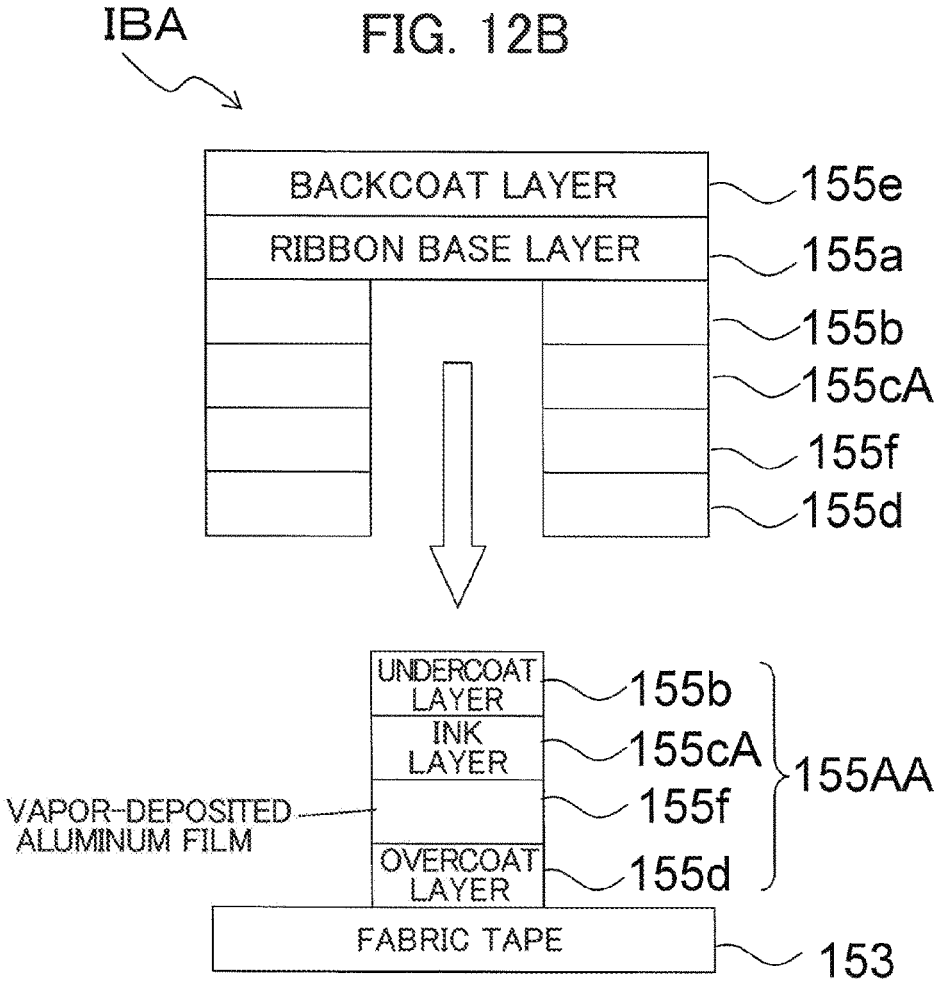
FIG. 12B illustrates behavior of the ink ribbon transferring to a fabric tape according to the modification.

When printing using the ink ribbon IBA having the above structure, the overcoat layer 155*d* melts when subjected to heat applied by the thermal head 11 and separates from the ribbon base layer 155*a*. Consequently, a transfer layer 155AA integrally configured of the undercoat layer 155*b*, ink layer 155*c*A, vapor-deposited aluminum film 155*f*, and overcoat layer 155*d* separates from the ribbon base layer 155*a*, as illustrated in FIG. 12B. Through this process, the transfer layer 155AA is transferred onto the printing surface 153A of the fabric tape 153, with the overcoat layer 155*d* of the transfer layer 155AA adhering to the printing surface 153A. In this way, the ink ribbon IBA forms a printed image on the printing surface 153A of the fabric tape 153, producing the printed fabric tape 153'. Since the ink layer 155*c*A in the printed image (transfer layer 155AA) is either transparent or translucent with no added colorants, the color produced by the vapor-deposited aluminum film 155*f* (silver) can render a silver color.

In the variation described above, the thickness (and specifically the coating weight) t4 of the ink layer 155*c*A is between 0.40 and 1.00 g/m$^2$, inclusive. Setting the thickness t4 of the ink layer 155*c*A to at least 0.40 g/m$^2$ can avoid insufficient color control resulting from the ink layer 155*c*A being too thin (the coating weight being too low). Further, setting the thickness t4 of the ink layer 155*c*A to less than or equal to 1.00 g/m$^2$ can avoid decreased permeability caused by the ink layer 155*c*A being too thick (the coating weight being too high), thereby avoiding decreased metallic luster and poorer heat transfer properties.

The remaining structure of the ink ribbon IBA described above is identical to the ink ribbon IB of the first embodiment.

The variation of the embodiment described above can obtain the same effects as those obtained with the first embodiment.

<Second Embodiment>

Next, a second embodiment of the present invention will be described.

<Overall Structure of a Printing Device>

First, the overall structure of a printing apparatus according to the second embodiment will be described with reference to FIGS. 13 through 15.

A printer 1000 (corresponding to the printing apparatus) shown in FIGS. 13 through 15 creates labels (not shown) by printing a desired print image on a fabric tape 1101 (described later) and cutting the resulting printed fabric tape 1109 to a prescribed length.

Figure 13:
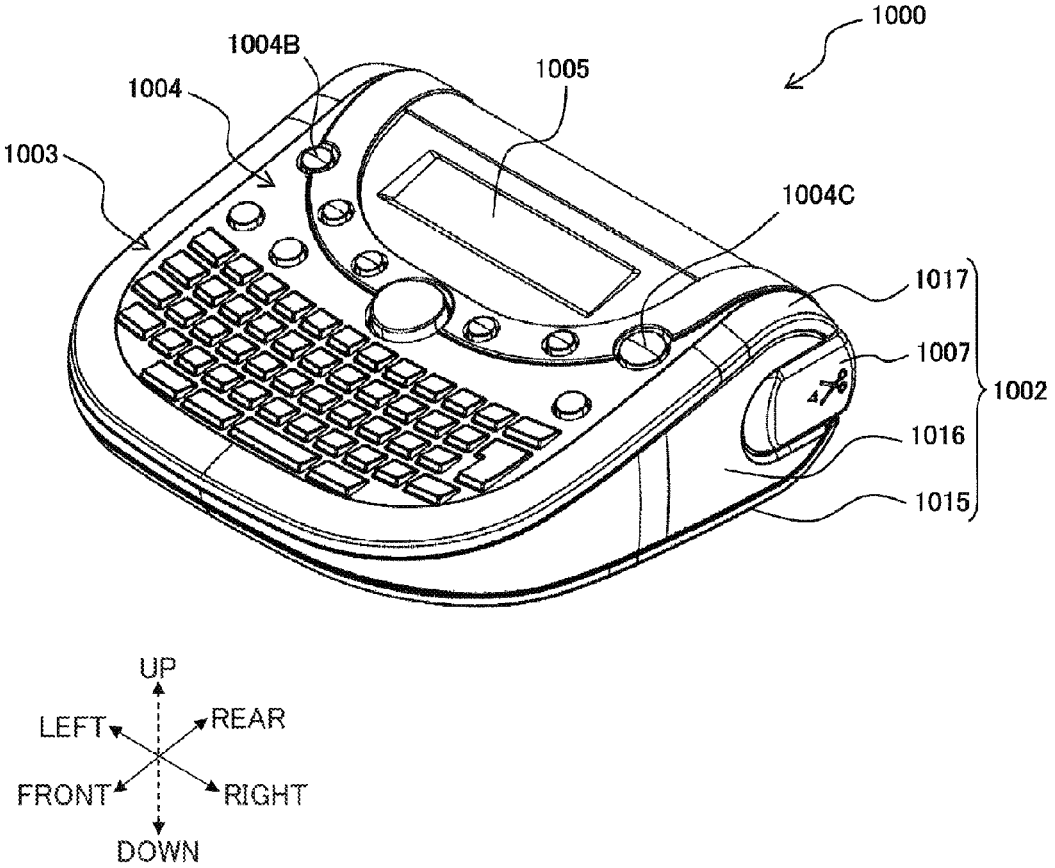
FIG. 13 is an upper perspective view of a printer according to a second embodiment.
Figure 14:
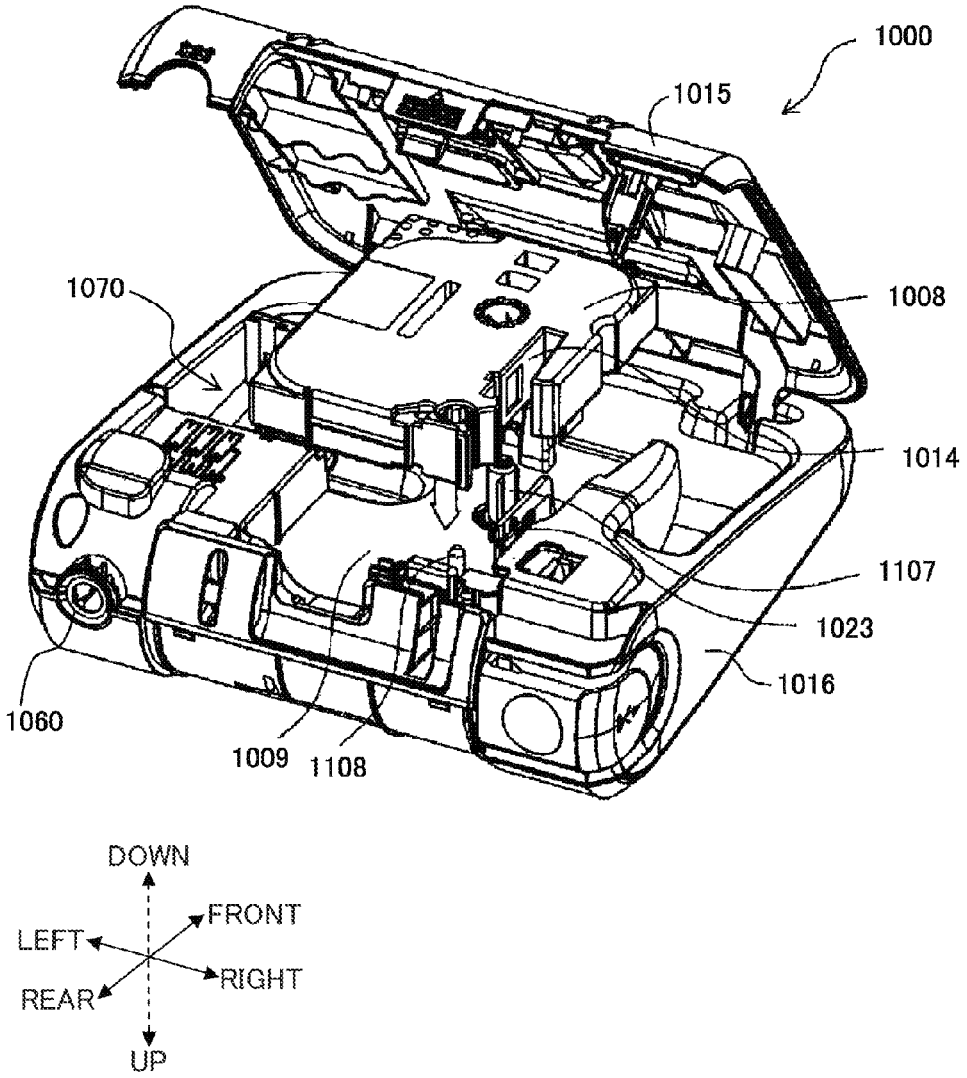
FIG. 14 is a lower perspective view of the printer according to the second embodiment in a condition where a bottom cover is opened.

As shown in FIGS. 13 and 14, the printer 1000 has a housing 1002. The housing 1002 is configured of a bottom cover 1015 constituting the bottom surface of the device, a side cover 1016 constituting the side surfaces of the device, and a top cover 1017 constituting the top surface of the device. The top cover 1017 is provided with, in positional order from the front side toward the rear, a keyboard 1003, a function key group 1004, and a liquid crystal display 1005. The keyboard 1003 allows a user to perform various operations, such as inputting characters. The keyboard 1003 is provided with the four cursor keys "↑", "←", "→", and "↓", in addition to the normal alphabetic and numeric keys, for example. The function key group 1004 enables the user to execute various functions of the printer 1000. The function key group 1004 includes a power switch 1004B, and a print key 1004C, for example. The liquid crystal display 1005 is provided for displaying characters (including symbols) and the like inputted via the keyboard 1003. A cutting lever 1007 is provided on the right-rear side of the side cover 1016 for cutting the printed fabric tape 1109 (see FIG. 15 described later).

A cartridge holder 1009 is provided in the upper-rear region of the printer 1000. A cartridge 1008 (corresponding to the ribbon cartridge is detachably mounted in the cartridge holder 1009. The bottom cover 1015 is capable of pivoting open and closed about a rotational shaft on the front side of the printer 1000. When closed, the bottom cover 1015 covers the cartridge holder 1009. When open, the bottom cover 1015 exposes the cartridge holder 1009.

As shown in FIG. 14, a battery accommodating section 1070 is disposed in the upper-front region of the printer 1000 adjacent to the cartridge holder 1009. A plurality of batteries BT (see FIG. 16 described later) can be accommodated in the battery accommodating section 1070. A DC jack 1060 is provided on the left-rear area of the printer 1000. The output plug of an AC adapter 1220 (see FIG. 16 described later) serving as an external power source is connected to the DC jack 1060.

<Cartridge>

Figure 15:
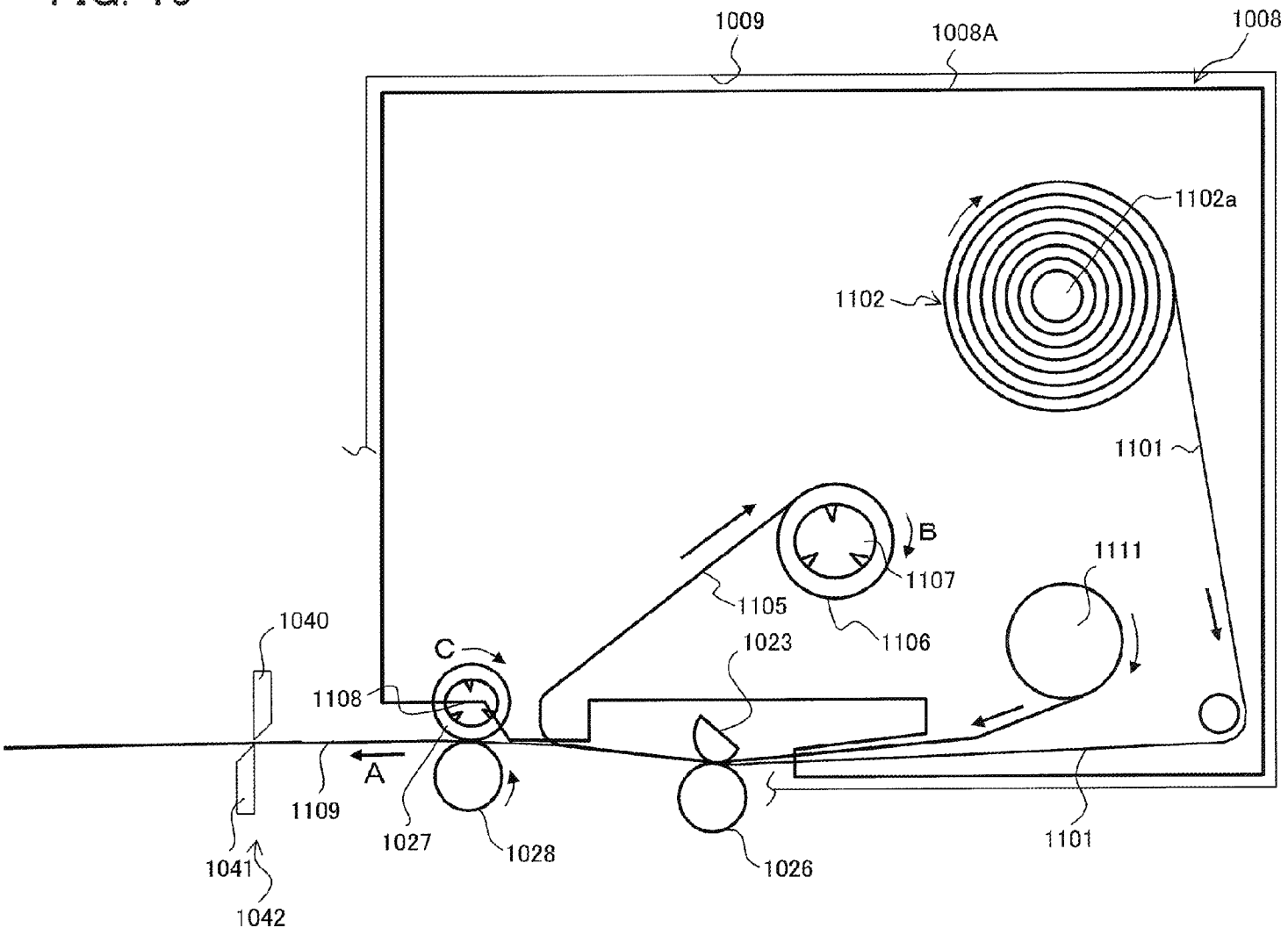
FIG. 15 is a schematic diagram showing an internal structure of a cartridge according to the second embodiment.

As shown in FIG. 15, the cartridge 1008 has an enclosure 1008A. Within the enclosure 1008A, the cartridge 1008 is provided with a first roll 1102 (simply depicted as concentric circles in the drawing, but actually configured in a roll shape), a ribbon supply-side roll 1111 (corresponding to the ink ribbon roll), a support member (not shown), a ribbon take-up roller 1106, and a tape-feeding roller 1027. The first roll 1102 is configured of a long fabric tape 1101 (corresponding to the recording medium and the satin-weave fabric medium) wound about a reel member 1102*a*. The ribbon supply-side roll 1111 pays out an ink ribbon 1105 (corresponding to the thermal transfer ink ribbon) that is wound about the axial center of the ribbon supply-side roll 1111. The support member rotatably supports the ribbon supply-side roll 1111. After use, the ink ribbon 1105 is taken up around the ribbon take-up roller 1106. The tape-feeding roller 1027 is rotatably supported near a tape outlet portion of the cartridge 1008.

The tape-feeding roller 1027 conveys the printed fabric tape 1109 in the direction indicated by an arrow A in FIG. 15.

As mentioned above, the first roll 1102 winds the fabric tape 1101 about the reel member 1102*a*. The ink ribbon 1105 is pressed by a thermal head 1023 (corresponding to the printer; see FIG. 14) so that the ink ribbon 1105 contacts a surface of the fabric tape 1101 paid out from the first roll 1102.

The cartridge holder 1009 is provided with a ribbon take-up roller drive shaft 1107 (see FIG. 14), and a tape-conveying roller drive shaft 1108 (corresponding to the conveyer; see FIG. 14) that correspond to the structure of the cartridge 1008 described above. The ribbon take-up roller drive shaft 1107 functions to take up the used ink ribbon 1105, while the tape-conveying roller drive shaft 1108 functions to drive the tape-feeding roller 1027 for conveying the printed fabric tape 1109. The thermal head 1023 for printing desired images on the fabric tape 1101 is arranged in the cartridge holder 1009 so as to be positioned within an open part 1014 of the cartridge 1008 (see FIG. 14) when the cartridge 1008 is mounted in the cartridge holder 1009.

A drive motor 1211 (see FIG. 16 described later), such as a pulse motor, is provided externally to the cartridge 1008. The drive motor 1211 transmits a drive force to the ribbon take-up roller drive shaft 1107 and tape-conveying roller drive shaft 1108 via gear mechanisms (not shown) for driving the ribbon take-up roller 1106 and tape-feeding roller 1027 to rotate in an interlocking relation with each other.

With this configuration of the printer 1000, the cartridge 1008 is mounted in the cartridge holder 1009, and a roller holder supporting a platen roller 1026 is moved from a release position (not shown) to a printing position as shown in FIG. 15. At this time, the ink ribbon 1105 is pinched between the thermal head 1023 and the platen roller 1026 provided in confrontation with the thermal head 1023, and the fabric tape 1101 is pinched between the tape-feeding roller 1027 and a pressure roller 1028 provided in confrontation with the tape-feeding roller 1027. The drive motor 1211 produces a drive force for rotating the ribbon take-up roller 1106 and tape-feeding roller 1027 synchronously in directions indicated by the respective arrows B and C in FIG. 15. Here, the tape-conveying roller drive shaft 1108 is coupled to the pressure roller 1028 and platen roller 1026 through a gear mechanism (not shown) so that the tape-feeding roller 1027, pressure roller 1028, and platen roller 1026 rotate when the tape-conveying roller drive shaft 1108 is driven to rotate. Through these rotations, the fabric tape 1101 is paid out from the first roll 1102 and supplied to the tape-feeding roller 1027.

In the meantime, a thermal head control circuit 1217 (see FIG. 16 described later) energizes a plurality of heating elements provided in the thermal head 1023, causing the heating elements to generate heat. As the ribbon take-up roller 1106 conveys the ink ribbon 1105 off the ribbon supply-side roll 1111, the ink ribbon 1105 is pressed against the thermal head 1023 while layered over the top surface of the fabric tape 1101. Thus, an image containing characters or the like inputted via the keyboard 1003 is printed onto the surface of the fabric tape 1101.

After printing is complete, the fabric tape 1101 becomes the printed fabric tape 1109. The tape-feeding roller 1027 and pressure roller 1028 discharge the printed fabric tape 1109 from the cartridge 1008. The ink ribbon 1105 used in the printing operation is subsequently taken up around the 1106 driven by the ribbon take-up roller drive shaft 1107.

A cutting mechanism 1042 is disposed on the outside of the cartridge 1008 at a position downstream of the tape-feeding roller 1027 and pressure roller 1028 along the conveying path of the printed fabric tape 1109. The cutting mechanism 1042 is provided with a fixed blade 1040 and a movable blade 1041. When the user operates the cutting lever 1007, the movable blade 1041 is actuated and cuts the printed fabric tape 1109 discharged from the cartridge 1008, producing a printed label.

<Control System>

Next, the control system of the printer 1000 will be described with reference to FIG. 16.

Figure 16:
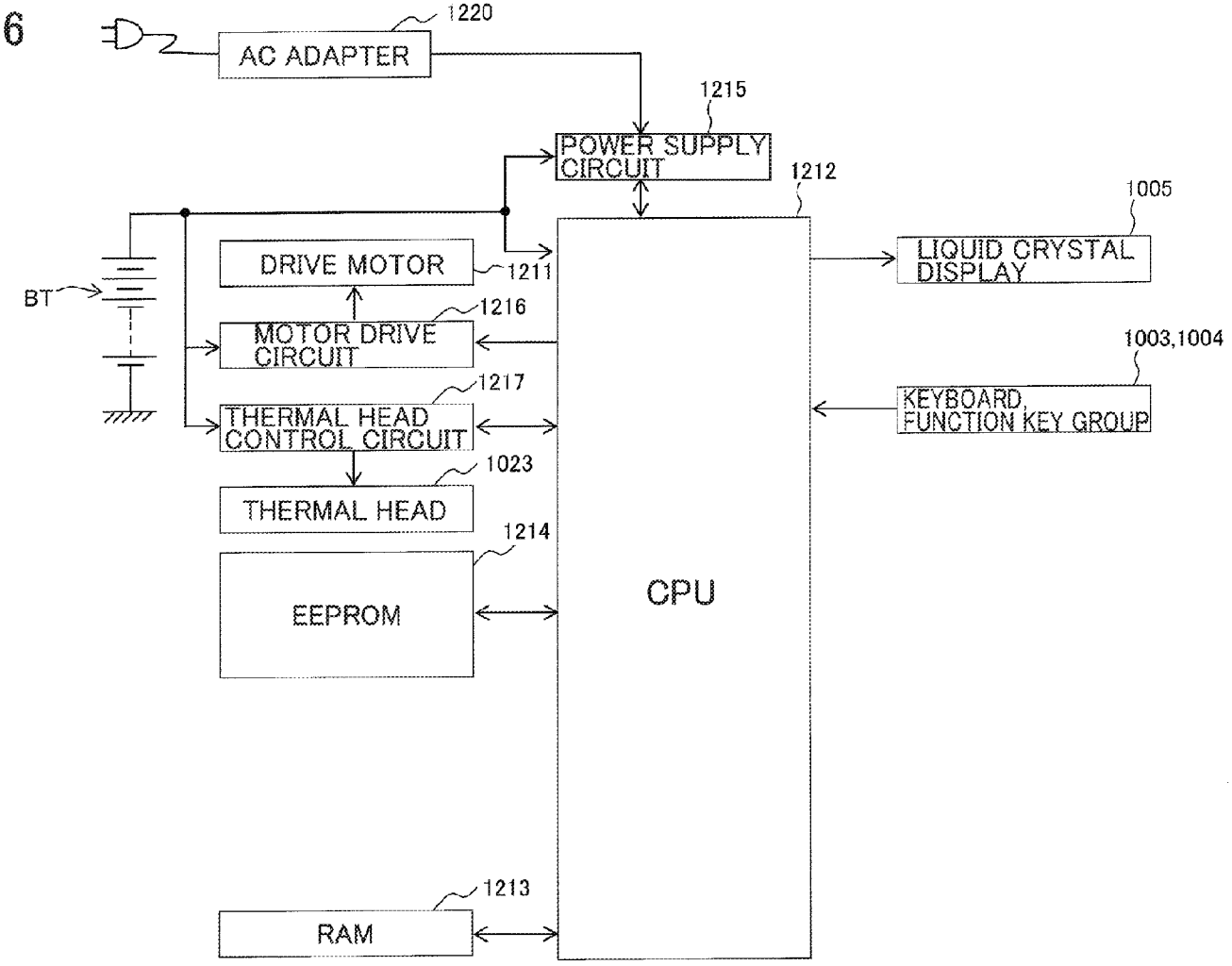
FIG. 16 is a functional block diagram illustrating a control system of the printer according to the second embodiment.

As shown in FIG. 16, the printer 1000 has a CPU 1212 that performs prescribed computations.

The CPU 1212 is connected to the keyboard 1003, function key group 1004, and liquid crystal display 1005 described above, as well as an EEPROM 1214, and a RAM 1213. The CPU 1212 is also connected to the AC adapter 1220, as well as a power supply circuit 1215 that turns power to the printer 1000 on and off, a motor drive circuit 1216 that controls the drive motor 1211 to drive the ribbon take-up roller drive shaft 1107 and tape-conveying roller drive shaft 1108, and a thermal head control circuit 1217 that controls energizing of the heating elements in the thermal head 1023.

The EEPROM 1214 stores various control programs. The CPU 1212 performs signal processing in accordance with a program stored in the ROM 1214 while utilizing a temporary storage function of the RAM 1213, thereby controlling overall operations of the printer 1000. In the preferred embodiment, the CPU 1212 controls the motor drive circuit 1216 and thermal head control circuit 1217 in synchronization with each other according to a well-known technique so that the speed of printing on the fabric tape 1101 is relatively slow, such as 10 mm/sec.

<Features of Embodiment>

The printer 1000 having the above configuration prints the surface of the fabric tape 1101 using the thermal head 1023 to thermally transfer ink from the ink ribbon 1105. In thermal transfer printing, the thermal head 1023 applies heat to the ink ribbon 1105. Ink in the ink ribbon 1105 subjected to heat is melted to be deposited on the surface of the fabric tape 1101, forming a print image thereon. In the preferred embodiment, the ink ribbon 1105 is used for printing in a gold color.

Figure 17A:
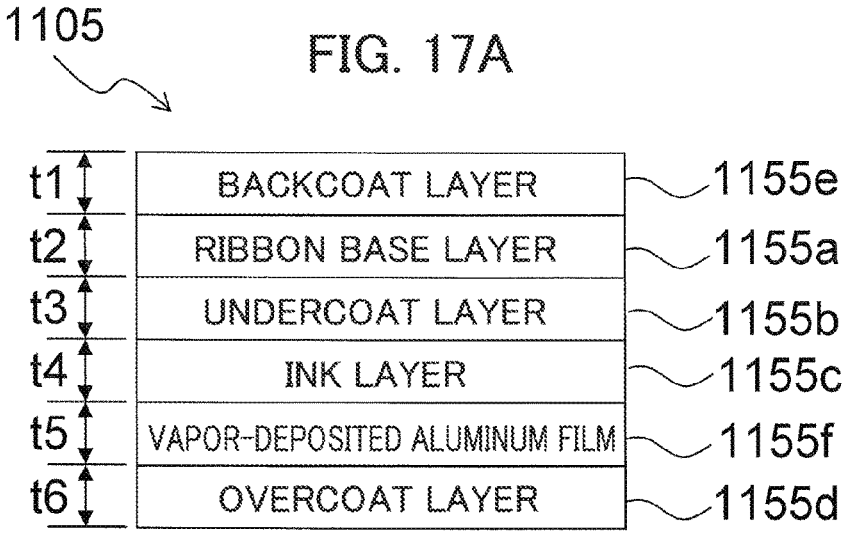
FIG. 17A is a schematic view showing in detail a layered structure of an ink ribbon for printing in silver color according to the second embodiment.

As a result of independent studies, the inventors and the like of this application discovered that the overall thickness dimension of the ink ribbon could be reduced and manufacturing costs could be decreased and that a loss in metallic luster in the print image and a loss in heat conductivity could be avoided by using the following layered structure for the ink ribbon, physical properties of each layer, and the like. Next, the ink ribbon 1105 according to the second embodiment will be described. FIG. 17A is a conceptual diagram showing in detail the layered structure of the ink ribbon 1105 according to the second embodiment.

As shown in FIG. 17A, the ink ribbon 1105 has the same layered structure as the ink ribbon IB described above in the first embodiment. That is, the ink ribbon 1105 has a six-layer structure that includes, in order from one side in the thickness direction (the top in FIG. 17A) to the other side (the bottom in FIG. 17A), a backcoat layer 1155*e*, a ribbon base layer 1155*a*, an undercoat layer 1155*b*, an ink layer 1155*c*, a vapor-deposited aluminum film 1155*f* (corresponding to the aluminum layer), and an overcoat layer 1155*d*.

Figure 17B:
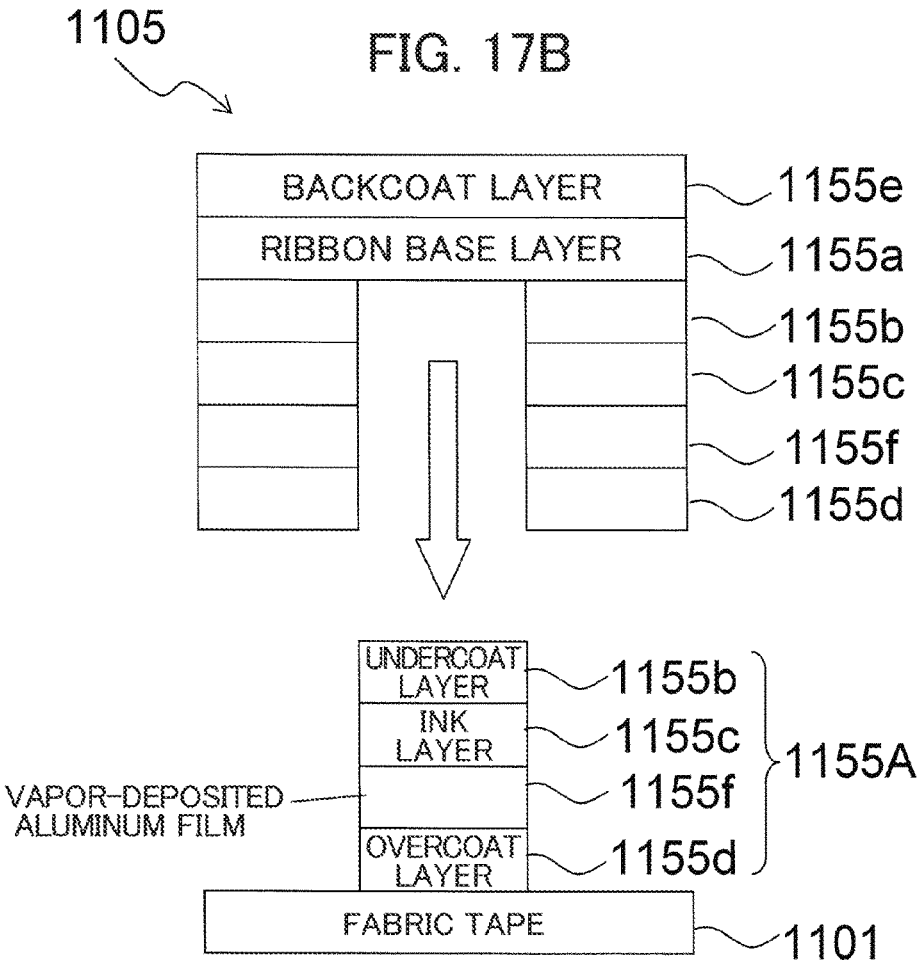
FIG. 17B illustrates behavior of the ink ribbon transferring to a fabric tape according to the second embodiment.

When printing with the ink ribbon 1105 having the above structure, the undercoat layer 1155*b* melts when subjected to heat applied by the thermal head 1023 and separates from the ribbon base layer 1155*a*. Consequently, a transfer layer 1155A integrally composed of the undercoat layer 1155*b*, ink layer 1155*c*, vapor-deposited aluminum film 1155*f*, and overcoat layer 1155*d* separates from the ribbon base layer 1155*a*, as illustrated in FIG. 17B. The transfer layer 1155A is transferred onto the surface of the fabric tape 1101 with the overcoat layer 1155*d* adhering to the surface of the fabric tape 1101. Through this process, a desired print image is formed by the transfer layer 1155A on the surface of the fabric tape 1101. Using the ink ribbon 1105 of the second embodiment to print an image on the surface of the fabric tape 1101 in this way generates the printed fabric tape 1109 described above. Here, the vapor-deposited aluminum film 1155*f* provided in the ink ribbon 1105 can produce a good metallic luster in the printed image formed on the fabric tape 1101. Further, suitable color control (tone adjustment or gold coloration, for example) can be performed on the color produced by the vapor-deposited aluminum film 1155*f* (silver) to render a gold color by adding yellow dye to the ink layer 1155*c* as a coloring agent (red dye may also be added).

Note that the physical properties and the like of the layers constituting the ink ribbon 1105 are identical to those of the ink ribbon IB described in the first embodiment.

However, in the second embodiment the mixing ratio of the first resin to the second resin in the ink layer 1155*c* is between 5:5 and 8:2, and the melting point of the overcoat layer 1155*d* is between 90° C. and 110° C. That is, since the printer 1000 of the second embodiment prints at a slower speed than that in the first embodiment, sufficient printing energy can be applied to the ink ribbon 1105 when the proportion of the first resin in the ink layer 1155*c* is higher than that in the first embodiment and the melting point of the overcoat layer 1155*d* is higher than that in the first embodiment.

Other than the differences described above, the structure of the ink ribbon 1105 is identical to the ink ribbon IB described in the first embodiment.

The second embodiment can obtain the same effects described in the first embodiment.

While the invention has been described in detail with reference to first and second embodiments thereof, it would be apparent to those skilled in the art that many modifications and variations may be made therein without departing from the spirit of the invention, the scope of which is defined by the attached claims.

Note that the arrows given in FIGS. 5 and 16 merely depict examples of signal flow, but the direction of signal flow is not limited to these examples.

What is claimed is:

1. A thermal transfer ink ribbon comprising:

a backcoat layer;

a ribbon base layer formed on the backcoat layer;

a release layer formed on the ribbon base layer and containing resin and wax;

an ink layer formed on the release layer and containing a first resin and a second resin, the first resin being transparent or translucent and containing at least one of polyester resin, styrene-acrylic resin, and polyethylene resin, the second resin being transparent or translucent and containing at least one of polyurethane resin, polypropylene resin, acrylic resin, and methacrylic resin;

an aluminum layer formed on the ink layer, wherein the aluminum layer is vapor-deposited aluminum film; and an adhesive layer formed on the aluminum layer and containing resin and wax.

2. The thermal transfer ink ribbon according to claim 1, wherein the first resin and the second resin have a relationship such that a mixing ratio of the first resin to the second resin falls within a range from 3:7 to 8:2, inclusive.

3. The thermal transfer ink ribbon according to claim 1, wherein the backcoat layer is defined by the following inequality expression:

$$0.1 \leq t1 \leq 0.2 \text{ g/m}^2,$$

where t1 is an area density of the backcoat layer.

4. The thermal transfer ink ribbon according to claim 1, wherein the ribbon base layer is defined by the following inequality expression:

$$4.0 \leq t2 \leq 5.0 \text{ μm},$$

where t2 is a thickness of the ribbon base layer.

5. The thermal transfer ink ribbon according to claim 1, wherein the release layer is defined by the following inequality expression:

$$0.6 \leq t3 \leq 1.0 \text{ g/m}^2,$$

where t3 is an area density of the release layer.

6. The thermal transfer ink ribbon according to claim 1, wherein the ink layer contains yellow dye and is defined by the following inequality expression:

$$0.45 \leq t4 \leq 1.05 \text{ g/m}^2,$$

where t4 is an area density of the ink layer.

7. The thermal transfer ink ribbon according to claim 1, wherein the ink layer is defined by the following inequality expression:

$$0.40 \leq t4 \leq 1.00 \text{ g/m}^2,$$

where t4 is an area density of the ink layer.

8. The thermal transfer ink ribbon according to claim 1, wherein the adhesive layer is defined by the following inequality expression:

$$0.1 \leq t6 \leq 0.5 \text{ g/m}^2,$$

where t6 is an area density of the adhesive layer.

9. An ink ribbon cartridge comprising:

an ink ribbon roll comprising a shaft, the thermal transfer ink ribbon according to claim 1 wound over the shaft; and a support member rotatably supporting the ink ribbon roll.

10. A printing apparatus comprising:

a conveyer configured to convey an elongated recording medium; and a printer using the thermal transfer ink ribbon according to claim 1 to print on the elongated recording medium conveyed by the conveyer.

11. The printing apparatus according to claim 10, further comprising a controller configured to control the conveyer and the printer in an interlocking relation for printing on the elongated recording medium at a speed falling within a range from 100 mm/sec to 200 mm/sec, inclusive.

12. The printing apparatus according to claim 10, wherein the elongated recording medium is a satin-weave fabric medium.

13. The thermal transfer ink ribbon according to claim 1, wherein the vapor-deposited aluminum film is defined by the following inequality expression:

$$350 \leq t5 \leq 550 \text{ Å},$$

where t5 is a thickness of the vapor-deposited aluminum film.

14. A thermal transfer ink ribbon comprising:

a backcoat layer;

a ribbon base layer formed on the backcoat layer;

a release layer formed on the ribbon base layer and containing resin and wax;

an ink layer formed on the release layer and containing a first resin being transparent or translucent and a second resin being transparent or translucent, the second resin having an acid value lower than that of the first resin and having a melting point lower than that of the first resin;

an aluminum layer formed on the ink layer; and an adhesive layer formed on the aluminum layer and containing resin and wax.

15. The thermal transfer ink ribbon according to claim 14, wherein the first resin has an acid value falling within a range from 3 to 10, inclusive.

16. The thermal transfer ink ribbon according to claim 15, wherein the first resin contains at least one of polyester resin, styrene-acrylic resin, and polyethylene resin.

17. The thermal transfer ink ribbon according to claim 14, wherein the second resin has a melting point falling within a range from 90 degrees centigrade to 130 degrees centigrade, inclusive.

18. The thermal transfer ink ribbon according to claim 17, wherein the second resin contains at least one of polyurethane resin, polypropylene resin, acrylic resin, and methacrylic resin.

* * * * *